US011111706B2

(12) United States Patent
Kenny et al.

(10) Patent No.: US 11,111,706 B2
(45) Date of Patent: Sep. 7, 2021

(54) LATCH ARRANGEMENT

(71) Applicant: Cavity Sliders Limited, Auckland (NZ)

(72) Inventors: Phillip Richard Kenny, Auckland (NZ); Adam Mark Waterman, Christchurch (NZ)

( * ) Notice: Subject to any disclaimer, the term of this patent is extended or adjusted under 35 U.S.C. 154(b) by 0 days.

(21) Appl. No.: 16/703,306

(22) Filed: Dec. 4, 2019

(65) Prior Publication Data

US 2020/0181960 A1 Jun. 11, 2020

Related U.S. Application Data

(63) Continuation of application No. 16/022,926, filed on Jun. 29, 2018, now abandoned, which is a (Continued)

(51) Int. Cl.

| | |
|---|---|
| ***E05B 61/00*** | (2006.01) |
| ***E05C 19/16*** | (2006.01) |
| ***E05B 63/06*** | (2006.01) |
| ***E05B 65/08*** | (2006.01) |
| ***E05B 15/00*** | (2006.01) |
| ***E05B 15/10*** | (2006.01) |

(Continued)

(52) U.S. Cl.

CPC ..... *E05C 19/163* (2013.01); *E05B 9/02* (2013.01); *E05B 15/006* (2013.01); *E05B 15/0205* (2013.01); *E05B 15/101* (2013.01); *E05B 17/2084* (2013.01); *E05B 63/06* (2013.01); *E05B 63/12* (2013.01); *E05B 65/087* (2013.01); *E05C 7/045* (2013.01); *E05C 19/168* (2013.01); *E05B 2015/023* (2013.01); *E05C 2007/007* (2013.01)

(58) Field of Classification Search

CPC ..... E05B 61/00; E05B 15/0205; E05B 55/00; E05B 47/00; E05B 9/07; E05B 15/006; E05B 15/005; E05B 15/101; E05B 17/2084; E05B 63/06; E05B 63/12; E05B 65/087; E05F 1/00; E05F 7/00; E05C 1/00; E05C 7/00; E05C 19/163; E05C 7/045; E05C 19/168; E05C 2015/023; E05C 2007/007

USPC ... 70/276, 95–100, 448, 450, 451, 461, 466; 292/DIG. 46, 251.5

See application file for complete search history.

(56) References Cited

U.S. PATENT DOCUMENTS 2,568,273 A * 9/1951 Clark ..... E05B 63/08 292/337
2,586,900 A * 2/1952 Alderman ..... E05C 19/163 292/74

(Continued)

FOREIGN PATENT DOCUMENTS

JP 2003278438 A * 10/2003
JP 2004137736 A * 5/2004

*Primary Examiner* — Suzanne L Barrett

(74) *Attorney, Agent, or Firm* — Dann, Dorfman, Herrell and Skillman, P.C.

(57) ABSTRACT

A latch arrangement for a sliding wing has a latching member that is movable by magnetic force from first position in which it is at least partially retracted within a latch housing, to a second position in which it extends at least partially out of the housing, to be received in a strike. The strike comprises a magnet or ferromagnetic arrangement to attract the latching member into a receiving and engaging formation of the strike when the sliding wing is located at or adjacent the strike.

17 Claims, 20 Drawing Sheets

Related U.S. Application Data continuation of application No. 14/898,790, filed as application No. PCT/IB2014/063496 on Jul. 29, 2014, now Pat. No. 10,036,185.

(60) Provisional application No. 61/859,432, filed on Jul. 29, 2013.

(51) Int. Cl.

| | |
|---|---|
| ***E05B 9/02*** | (2006.01) |
| ***E05B 15/02*** | (2006.01) |
| ***E05B 17/20*** | (2006.01) |
| ***E05B 63/12*** | (2006.01) |
| ***E05C 7/04*** | (2006.01) |
| *E05C 7/00* | (2006.01) |

(56) References Cited

U.S. PATENT DOCUMENTS 2,677,443 A * 5/1954 Kottick ..... E05C 1/163 49/503
2,815,655 A * 12/1957 Boer ..... E05B 9/08 70/451
2,840,408 A * 6/1958 Scott ..... E05C 19/16 292/251.5
2,877,041 A * 3/1959 Foley ..... E05C 19/16 292/251.5
3,516,701 A * 6/1970 Graham ..... E05C 19/163 292/144
3,626,712 A * 12/1971 Mann et al. ..... F25D 29/006 62/161
3,794,366 A * 2/1974 Graham ..... E05C 19/163 292/144
4,026,588 A * 5/1977 Bisbing ..... E05C 19/165 292/251.5
5,722,276 A * 3/1998 Aigner ..... E05B 9/002 292/337
6,094,869 A * 8/2000 Magoon ..... E05B 9/002 49/460
6,679,533 B1 * 1/2004 Bruner ..... E05B 15/0205 292/346
8,006,527 B2 * 8/2011 Nowakowski ..... E05B 65/0007 70/417
8,261,584 B2 * 9/2012 Yang ..... E05B 63/044 70/107
10,036,185 B2 * 7/2018 Kenny ..... E05B 15/006
2008/0012359 A1 * 1/2008 Aschieri ..... E05C 19/163 292/251.5
2011/0192203 A1 * 8/2011 Uyeda ..... E05B 59/00 70/461
2014/0217749 A1 * 8/2014 Chartier ..... E05C 1/06 292/145
2019/0226240 A1 * 7/2019 Sullivan ..... E05B 9/08

* cited by examiner

LATCH ARRANGEMENT

CROSS REFERENCE TO RELATED APPLICATION

This application is a continuation of U.S. application Ser. No. 16/022,926, filed Jun. 29, 2018 which is a continuation of U.S. application Ser. No. 14/898,790, filed Dec. 16, 2015 which is the U.S. national stage of PCT/IB2014/063496, filed Jul. 29, 2014 which claims the benefit of U.S. Provisional application No. 61/859,432, filed Jul. 29, 2013, the entireties of which are incorporated herein by reference.

FIELD OF THE INVENTION

The present invention relates to a latch arrangement. More particularly but not exclusively it relates to a magnetic latch arrangement for a sliding door or window.

BACKGROUND TO THE INVENTION

Sliding doors, and especially sliding doors that are suspended from a rolling carriage, have a tendency when moved to reach the end of their travel path, and rebound off an end stop. The door then remains slightly ajar or not completely open.

Further, designing a simple latch for a sliding door, and in particular a sliding door that is able to be received into a cavity for the door in its open condition, is problematic. This is because the latch must preferably not extend transversely outwardly from the direction of movement of the sliding door as it may damage the cavity into which the door is receivable. It is preferable for such latches to extend outwardly from the door in the plane of the door. However, in order to latch with a suitable strike, the latch requires further movement transversely to the initial extension direction. Such mechanisms are typically complex and hence costly.

For indoor sliding doors, and especially sliding doors receivable into a cavity, there is a requirement for a clean looking, simple, latching system that may be moved to a locked condition by a snib or key.

In this specification, where reference has been made to external sources of information, including patent specifications and other documents, this is generally for the purpose of providing a context for discussing the features of the present invention. Unless stated otherwise, reference to such sources of information is not to be construed, in any jurisdiction, as an admission that such sources of information are prior art or form part of the common general knowledge in the art.

For the purposes of this specification, the term "plastic" shall be construed to mean a general term for a wide range of synthetic or semisynthetic polymerization products, and generally consisting of a hydrocarbon-based polymer.

For the purpose of this specification, where method steps are described in sequence, the sequence does not necessarily mean that the steps are to be chronologically ordered in that sequence, unless there is no other logical manner of interpreting the sequence.

OBJECT OF THE INVENTION

It is an object of the present invention to provide a latch arrangement which overcomes or at least partially ameliorates some of the abovementioned disadvantages or which at least provides the public with a useful choice.

SUMMARY OF THE INVENTION

In a first aspect, the present invention may be said to consist in a latch arrangement for a sliding wing, the latch arrangement comprising a) a housing;

b) a latching mechanism located in the housing, the latching mechanism comprising a latching member comprising one or both of:
   (i) a magnet,
   (ii) a ferromagnetic portion,
   the latching member being movable along a first direction between
   (i) a first position in which the latching member is at least partially retracted within the housing, and
   (ii) a second position in which the latching member extends at least partially out of the housing for being received by a strike,
   wherein the latching mechanism is movable from the first position to the second position by magnetic force, and c) a latch moving mechanism configured and adapted for translating the latching member, when in said second position, along a second direction substantially transverse to the first direction, the latch moving mechanism configured to translate the latching member between:
   (i) an engaged position in which the latching member is prevented from retracting from the strike and returning to the first retracted position within the housing, such that the sliding wing is fixed with respect to the strike, and
   (ii) a disengaged position in which the latching member is movable to retract from the strike and return to the first position, such that the sliding wing is movable with respect to the strike.

Preferably the latching member, in the second position, is configured to extend from a minor face of the housing, wherein the minor face of the housing is coplanar with and/or parallel to a minor face of the sliding wing.

Preferably the latching member is biased towards the first position via a spring formation.

Preferably the length which the latching member extends from the housing in the second position is adjustable by an adjustment mechanism.

Preferably the length which the latching member extends from the housing in the second position is adjustable by a threaded formation.

Preferably the adjustment mechanism allows for adjustment of the biasing force exerted by the spring formation.

Preferably the latch arrangement is installed in the sliding wing such that the latching member in the first position is configured to be located flush with an edge of the sliding wing operationally.

Preferably the latch arrangement comprises a locking mechanism for locking movement of the latch moving mechanism at least in the engaged position, and wherein the locking mechanism is a key barrel.

Preferably the latching member defines a neck formation and a head formation.

Preferably the housing comprises at least one shroud formation extending from the minor face of the housing, wherein the shroud formation at least partially surrounds the latching member to prevent access to the latching member between the strike and the housing when the latching member is in the second position, and wherein the latching member extends beyond the length of the shroud formation when the latching member is in the second position.

Preferably the shroud formation comprises one or both of:

a) a magnet, b) a ferromagnetic portion;

the shroud being movable by magnetic force from a first shroud position in which it is at least partially retracted within the housing to a second shroud position in which the shroud formation extends at least partially from the housing.

Preferably the shroud formation is movable from the second shroud position to the first shroud position via engagement and movement with the latching member as the latching member is moved from the second position to the first position.

Preferably the shroud formation is biased towards the first shroud position via a spring formation.

Preferably the strike comprises a body comprising:

a) a cavity, b) a receiving formation c) an engaging formation; and d) one or both of: a magnet and/or a ferromagnetic element, wherein said magnet and/or ferromagnetic element is configured and dimensioned to operationally magnetically attract and move the latching member along said first direction, through said receiving formation and into said cavity, wherein the latching member is in said second position, when the sliding wing is located at or adjacent the strike, and wherein the engaging formation engages the latching member when the latching member is translated along said second direction to said engaged position.

Preferably the receiving formation comprises one or more selected from a recess and an aperture, wherein the engaging formation comprises a slot formation, and wherein the engaging formation extends from an edge of the receiving formation such that the receiving and engaging formations define an aperture contiguous with the cavity, the receiving formation defining a major lobe and the engaging formation defining a minor lobe of the recess.

Preferably the strike housing comprises at least one shroud formation extending from the strike body, wherein the shroud formation at least partially surrounds the latching member to prevent access to the latching member between the strike and an associated lock housing of the latching member when the latching member is engaged with the strike.

Preferably the shroud formation comprises one or both of:

a) a magnetic portion, b) a ferromagnetic portion;

the shroud being movable by magnetic force from a first shroud position in which it is at least partially retracted within the strike body to a second shroud position in which the shroud formation extends at least partially from the strike body.

Preferably the shroud formation is biased towards the first shroud position via a spring.

Preferably the strike further comprises a lip protruding in the direction of the sliding wing on which the latching member is located, wherein the lip is positioned adjacent the engaging formation along the second direction.

Preferably the strike comprises a top lip and a bottom lip, wherein the top lip is positioned above the receiving formation and the bottom lip is positioned below the engaging formation.

Other aspects of the invention may become apparent from the following description which is given by way of example only and with reference to the accompanying drawings.

As used herein the term "and/or" means "and" or "or", or both.

As used herein "(s)" following a noun means the plural and/or singular forms of the noun.

The term "comprising" as used in this specification [and claims] means "consisting at least in part of". When interpreting statements in this specification and claims which include that term, the features, prefaced by that term in each statement, all need to be present but other features can also be present. Related terms such as "comprise" and "comprised" are to be interpreted in the same manner.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

BRIEF DESCRIPTION OF THE DRAWINGS

The invention will now be described by way of example only and with reference to the drawings in which.

DETAILED DESCRIPTION OF THE EMBODIMENT(S)

With reference to the above drawings, in which similar features are generally indicated by similar numerals, a latch arrangement according to a first aspect of the invention is generally indicated by the numeral 1000.

Figure 21:
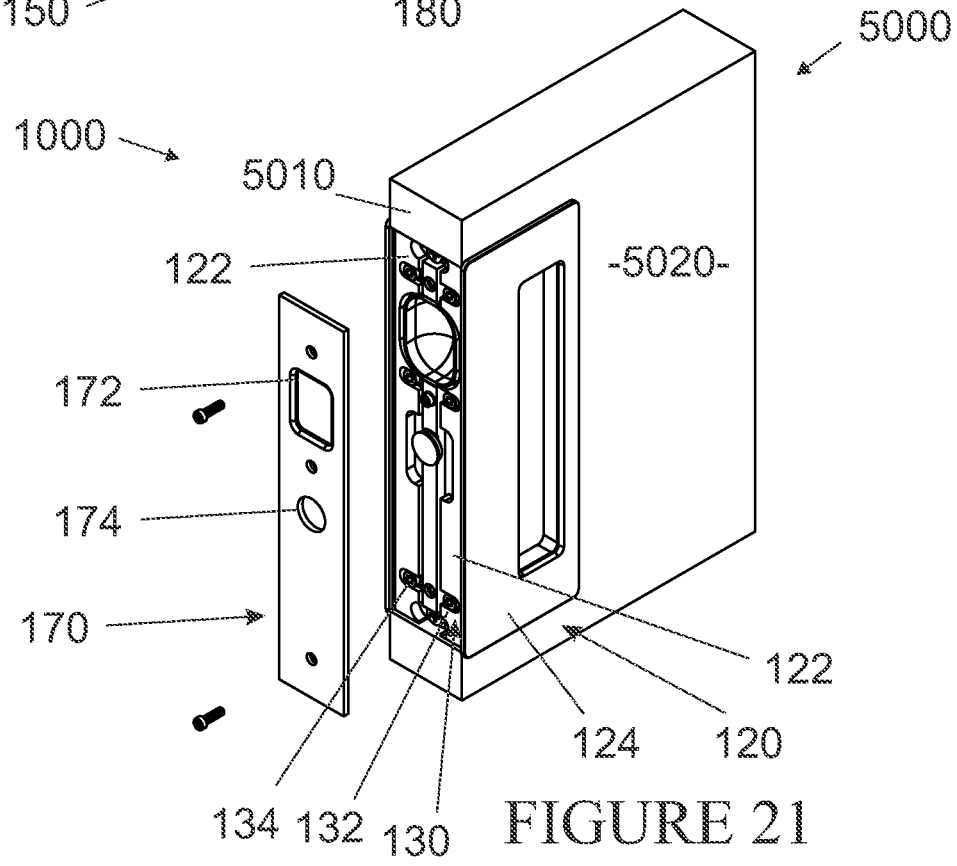
FIG. 21: shows a front isometric view of an exploded latch and a sliding wing.
Figure 22:
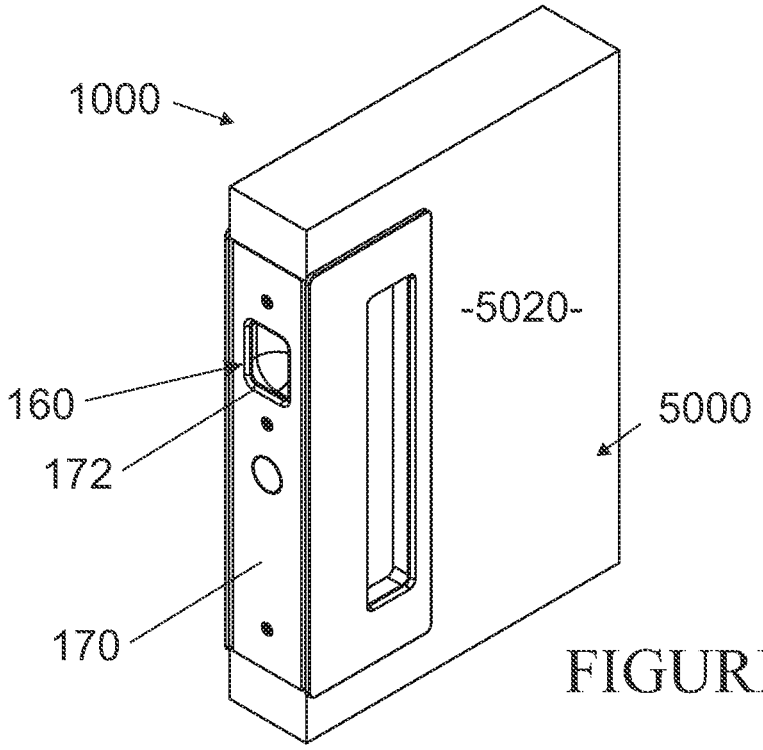
FIG. 22: shows a front isometric view of a latch that is not moveable into an engaged position and a sliding wing.

In one embodiment now described, there is provided a latch arrangement 1000 comprising a housing 100 and a latching mechanism 200 as shown in FIGS. 21-22. The latching mechanism 200 is generally located within the housing 100 as shown in FIGS. 1-10. The latch arrangement 1000 is envisaged as being particularly suitable for use with sliding wings 5000, such as sliding doors and/or sliding windows that move between an open position and a close position in a sliding manner. Further, the latch arrangement is envisaged as being particularly suitable for such sliding wings 5000 where the sliding wing moves into a recessed cavity (not shown) in its open position.

The housing 100 is configured to be secured at or towards a minor edge of a sliding wing as shown in FIG. 22, such as a sliding door or sliding window. Preferably, the housing 100 will be configured to be received within a recess or aperture in the sliding wing 5000 adjacent or at a minor face 5010 of the sliding wing.

The housing 100 defines a pair of opposed major faces 140 and at least one minor face 150. In operation, when the housing is received within a recess or aperture in the sliding wing, the minor face 150 will preferably be aligned with a minor face of the sliding wing 5000, and the major faces 140 will be aligned with the major faces of the sliding wing.

The housing 100 comprises a chassis member 110 and a pair of cover members 120. The cover members 120 are configured to be secured to the chassis member 110 on opposed sides of the chassis member 110 to define the major faces 140 of the housing 100. The cover members 120 comprise a generally planar side cover member 124 and a lip 122 extending from at least part of the periphery of the side cover members. Each of the side cover members 124 is configured for alignment operationally with a major face of the sliding wing. Although it is envisaged that the side cover member 124 may extend out of plane of the major face of the sliding wing, this would present difficulties where the sliding wing is configured to be received into a cavity.

In one embodiment, chassis member 110 may itself define a minor face 150 of the housing 100, however in a preferred embodiment, a face cover member 170 is provided to be mounted to the chassis member 110, and which defines the minor face 150. The minor face 150 is configured to generally align with a minor face of sliding wing 5000.

The face cover member 170 is configured for covering the chassis member 110 operationally along a plane coplanar with a minor face of the sliding wing 5000.

The chassis member 110 preferably defines a handle recess 112, and the face cover member 170 defines a handle aperture 172 that aligns with the handle recess 112 operationally to define a handle formation on the minor face of the housing, through which a user can insert their fingers to pull the sliding wing 5000 closed, for example where the sliding wing moves into a recessed cavity (not shown) in an open position. It is also envisaged that one or more of the opposed cover members can include a handle formation, however would not be preferred where sliding wing moves into a recessed cavity in an open position.

In one preferred embodiment, the chassis member 110 is extruded and preferably composed of aluminium, although it is also envisaged that it could composed of any other extruded material.

The opposed cover members 120 and chassis member 110 are preferably configured to be secured to each other by adjustable securing formations 130. The adjustable securing formations comprise a plurality of fasteners in the form of screws 134 that are mountable in threaded holes 114 in the chassis member 110, and which receivable into open-ended slots 132 in the lip 122 of the cover members 120.

The open-ended slots 132, the screws 134 and the threaded holes 114 together comprise a fastening arrangement configured and adapted for securing the adjustable engaging formation to the chassis member operationally in an adjustable manner, to allow the width of the housing to match the width of the sliding wing.

In one preferred embodiment, the minor face defines a centrally located ridge 152 running vertically, and an angled surface 154 extending to either side of the ridge 152 towards opposed major faces 180 of the housing 100. The angled surfaces are configured not to extend perpendicularly to the plane of a major face of the sliding wing operationally, and instead extend vertically alongside the ridge 152 and in a range of between 80 to 90° out of plane of a major face of the sliding wing operationally.

During installation, the fasteners 134 obviously received into the threaded holes in the chassis member 110. The cover members 120 are then mounted to either side of the chassis member 110 and the fasteners 134 are each located in a slot 132. The cover members 120 are adjusted to match the width of the sliding wing, with the fasteners 134 sliding along the slots 132. The fasteners 134 are then tightly secured to the chassis member 110 by turning them in, to thereby hold the cover members 120 securely in place relative to the chassis member 110 in a friction fit.

Figure 11:
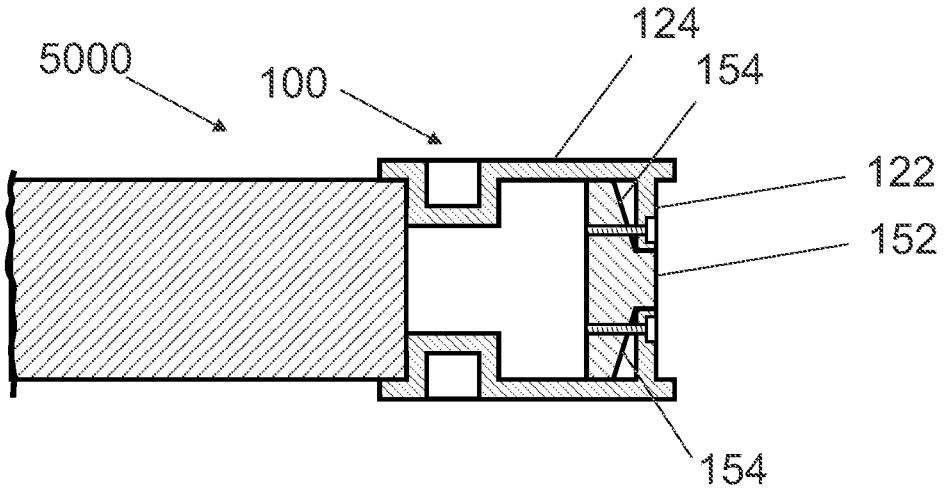
FIG. 11: shows a top schematic view of a latch housing engaged with a sliding wing.

As shown in FIG. 11, when the screws 134 are turned into the threaded holes 114, they apply a force on to the lip 122, pushing the lip 122 against one of the angled surfaces 154 until a distal end of the lip 122 abuts against one of the angled surfaces 154. In this way a turning moment is applied to the cover member 120, ensuring that the side cover member 124 is pushed against the sliding wing 5000 to engage snugly with it.

In this way, a smaller number of sizes of chassis members can be produced, but which can still fit a large variety of sliding wing widths. The reduction of part numbers allows for reduced stock, reduced transportation costs, and increased efficiency. Installation time may be reduced and the convenience of installation increased.

Figure 12:
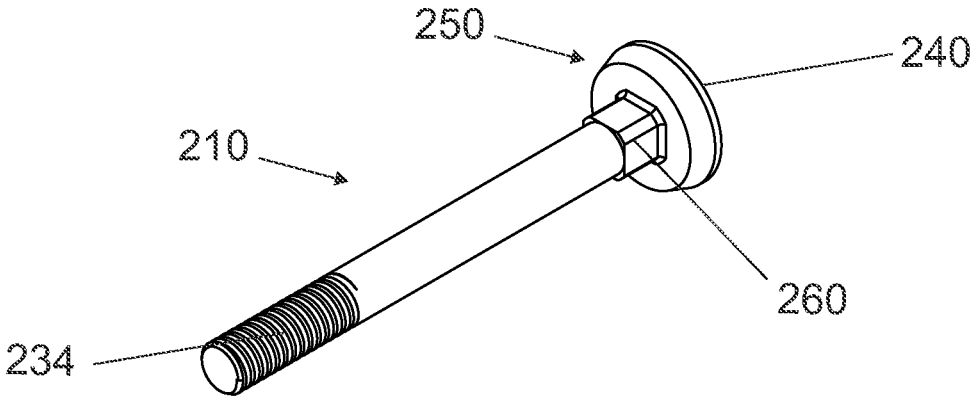
FIG. 12: shows a rear perspective view of a latching member.
Figure 13:
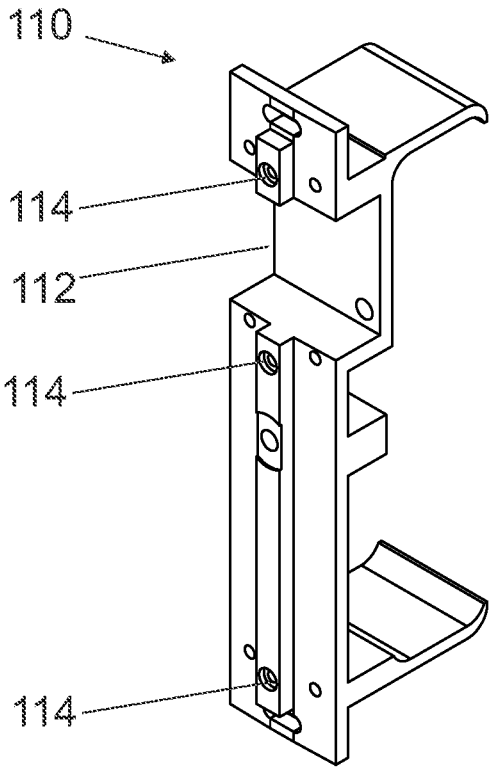
FIG. 13: shows a front perspective view of a chassis member configured for a non-engageable latch member.
Figure 14:
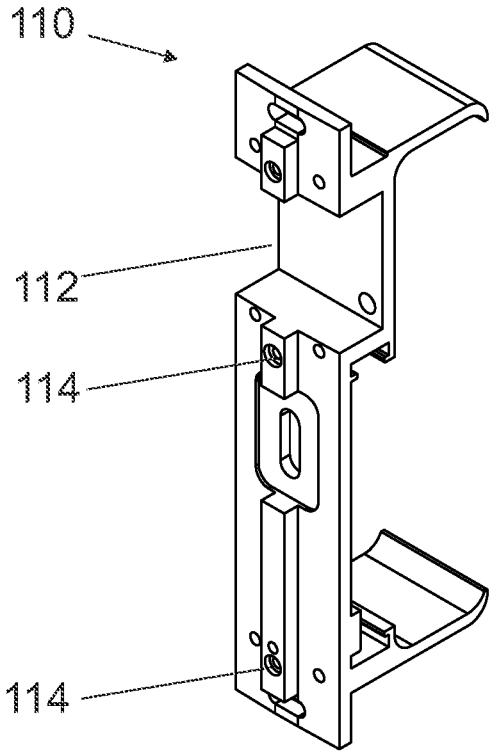
FIG. 14: shows a front perspective view of a chassis member configured for an engageable latch member.
Figure 15:
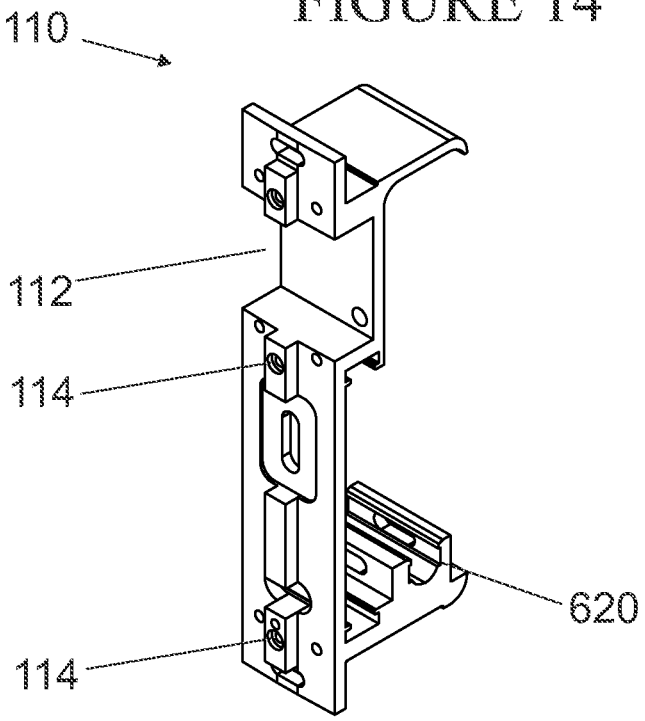
FIG. 15: shows a front perspective view of a chassis member configured for a lockable engageable latch member.

The latching mechanism 200 comprises a latching member 210 as shown in FIG. 12. The latching member 210 is movable between a first position in which it is retracted to a position within the housing 100, and a second position in which the latching member 210 extends out of the housing 100 to be received by a strike 2000. In a preferred embodiment, latching member 210 extends through a latch aperture 174 in the face cover member 170 when moving between its first position and second position.

The latching member 210 comprises a portion 240 that may be magnetically moved to move the latching mechanism between its first position and second position. In a preferred embodiment, the entire latching member 210 will be composed of ferromagnetic material such as iron or steel. In an alternative embodiment, it is envisaged that a permanent magnet (not shown) may be embedded in the latching member to enhance its magnetic attraction.

In a preferred embodiment, the latching member 210 defines a head formation 250 and a neck formation 260. The head formation 250 and neck formation 260 are configured for being receivable within a slot formation on an associated strike 2000 as will be described below.

In a preferred embodiment, the latching member 210 is biased by a spring 220 to move it towards its first position. The latching member 210 is movable against the biasing force of the spring 220 by being magnetically attracted by a magnet or electromagnet in an associated strike 2000 shown in FIGS. 6-9.

In an alternative case where a permanent magnet is embedded in the latching member 210, the associated strike 2000 may comprise a ferromagnetic material which would be similarly magnetically attracted to the latching member, so that the latching member is movable against the biasing force of the spring 220 towards the strike.

Alternatively or additionally, the strike may comprise a magnet which is sufficiently strong to attract the latching member together with the entire sliding wing when the sliding wing is close to the strike, such that the sliding wing may be pulled close by the magnet in the last part of its movement towards the strike.

Preferably, the latching member 210 is configured to extend from a face of the housing 100 coplanar with and/or parallel to a minor face of the sliding wing when the latching member 210 in its second position.

Figure 1:
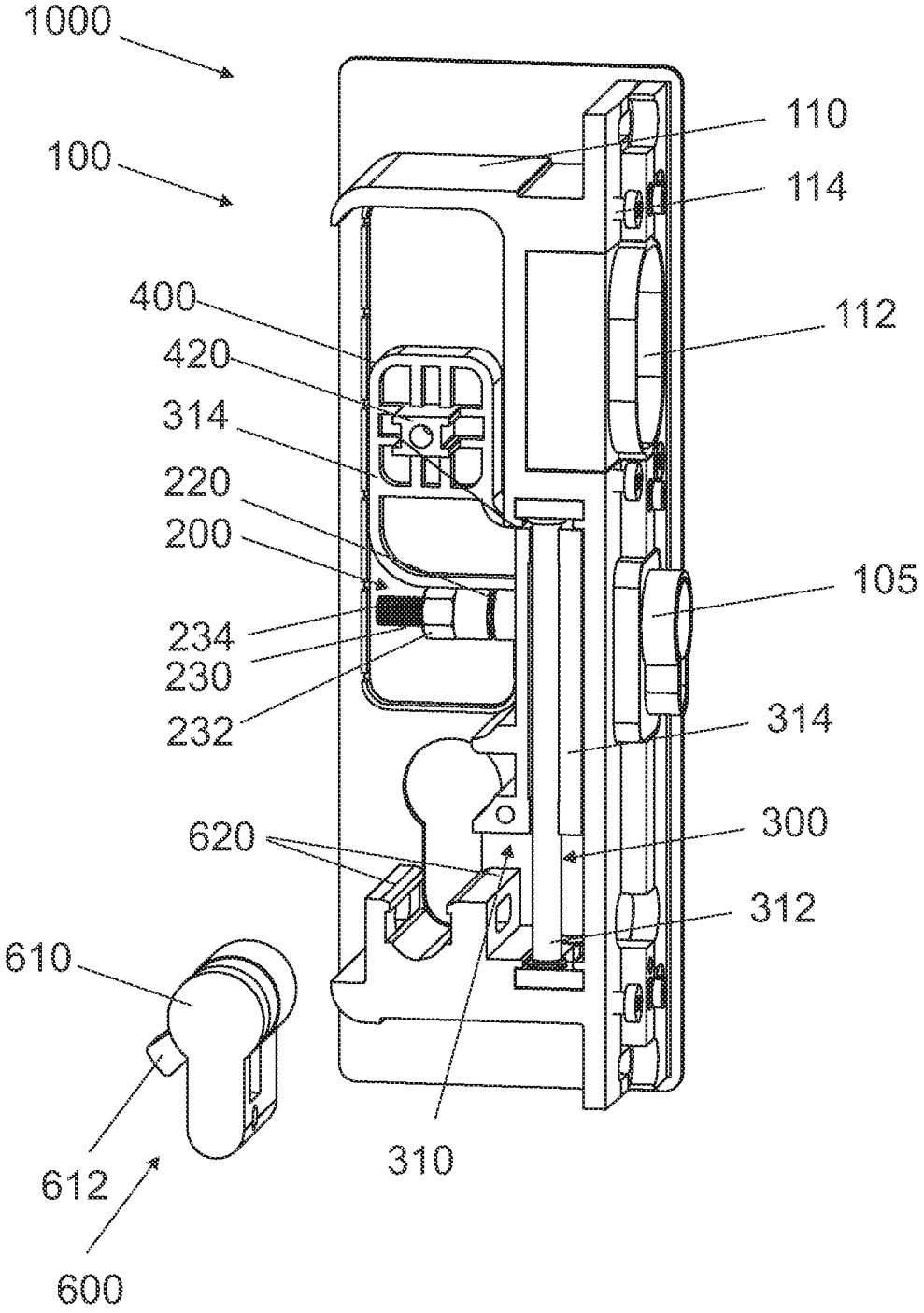
FIG. 1: shows a side isometric view of a latch housing with a cover plate removed, and the key barrel exploded.
Figure 2:
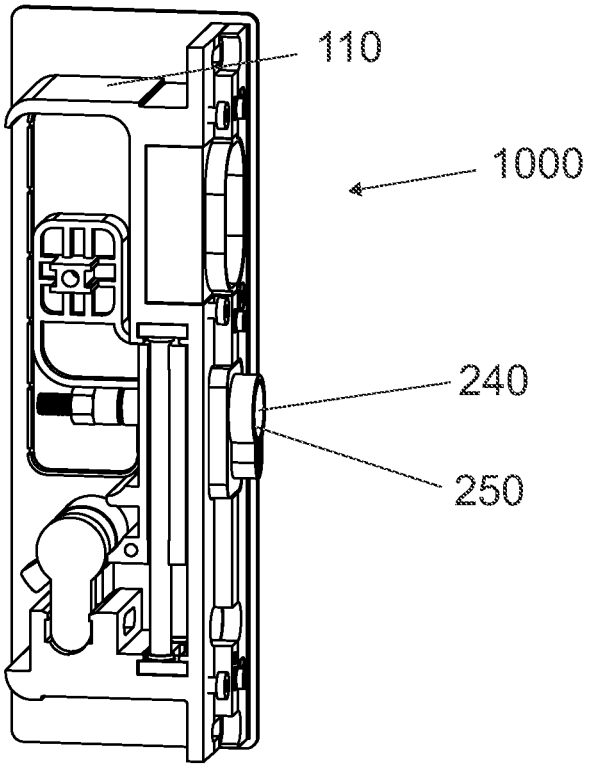
FIG. 2: shows a side isometric view of a latch housing with a cover plate removed, and the key barrel located in the latch chassis.
Figure 3:
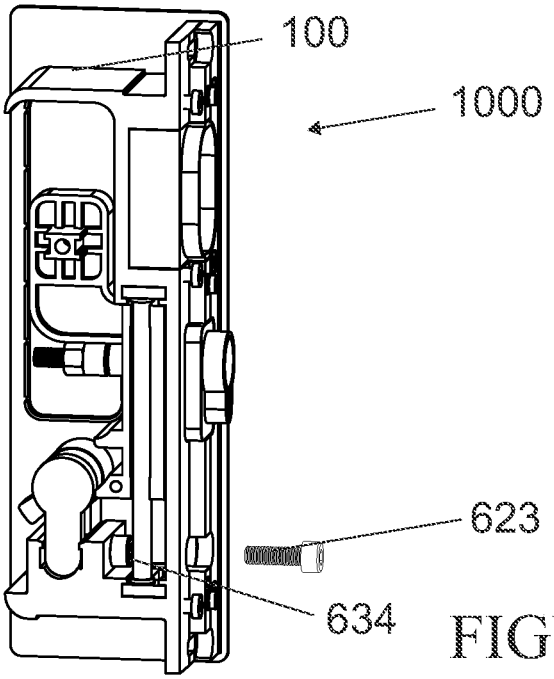
FIG. 3: shows a side isometric assembly view of a latch housing with a cover plate removed, and the key barrel engaged in the latch chassis.
Figure 4:
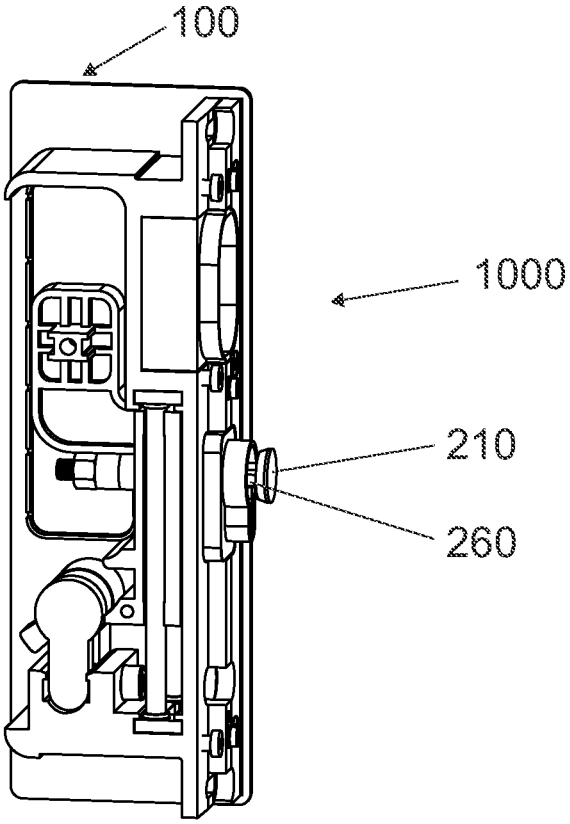
FIG. 4: shows a side isometric view of a latch of a latch housing, with a latching member extended.

In a preferred embodiment, the latching mechanism 200 comprises an adjustment mechanism 230 by which the length that the latching member 210 extends from the housing 100 in its second position is adjustable. It is envisaged that the adjustment mechanism 230 will comprise a nut 232 movable on a thread formation 234 as shown in FIG. 1.

Additionally, by adjusting the extent to which the spring formation is pre-compressed, the adjustment mechanism 230 will also allow for adjustment of the biasing force exerted by the spring formation. In this way, the sensitivity of the latching member 210 to being magnetically drawn out of the housing 100 may be adjusted. However, it is preferable that a relatively weak spring is used to allow high sensitivity to the latch member being drawn out of the housing.

The latch arrangement 1000 further comprises a latch moving mechanism 300. The latch moving mechanism 300 is configured and adapted for moving the latch member in operation preferably in a vertical direction, between an engaged position in which the head and neck formation is operationally engaged with complementary engaging formations on a strike 2000 (as will be discussed below), and a disengaged position in which the latch member is retracted into the housing 100 to sit flush with a face of the housing 100. The latch moving mechanism 300 moves the latch member 210 in a direction substantially transverse to the direction of movement of the latching member 210 between its first position and second position.

In one preferred embodiment, the latch moving mechanism 300 comprises guide arrangement 310 for guiding movement of one or both of the snib 400 and the latching member 210. In a preferred embodiment, the guide arrangement 310 comprises a nylon, or similar plastic sliding member 314 that is slidably movable along a pair of shafts 312.

It is anticipated that the latch moving mechanism 300 may move under force of gravity from its engaged position towards its disengaged position as the sliding wing 5000 is being opened from a closed condition (when the latch arrangement 1000 abuts strike 2000) to an open condition. This would occur before the latching member 210 has had a chance to move from its second position to its first position (in which the latching member is prevented from moving downwardly).

It is further anticipated that the latch moving mechanism 300 may move back from its disengaged position to its engaged position by being attracted to the magnet or ferromagnetic arrangement 2300 on the strike 2000 after a user has moved the latch moving mechanism 300 to its engaged position and released the snib 400.

For this reason, in a preferred embodiment, the latching moving mechanism 300 comprises a holding arrangement (not shown) for holding the latch moving mechanism in place in either of its engaged position or disengaged position against these relatively weak forces.

The holding arrangement will preferably comprise a ball (not shown) located in a bore (not shown) in the sliding member 314 that is biased towards a shaft 312. The shaft 312 has locating formations in it, in the form of small notches (not shown). As the latch moving mechanism 300 moves into its engaged position or its disengaged position, the ball will locate in one of the notches, thereby providing sufficient holding force to prevent the latch moving mechanism 300 from being moved by gravity or magnetic attraction.

The latch moving mechanism 300 will still be able to be manually manipulated between its engaged position and disengaged position when the ball is located in a notch.

Figure 5:
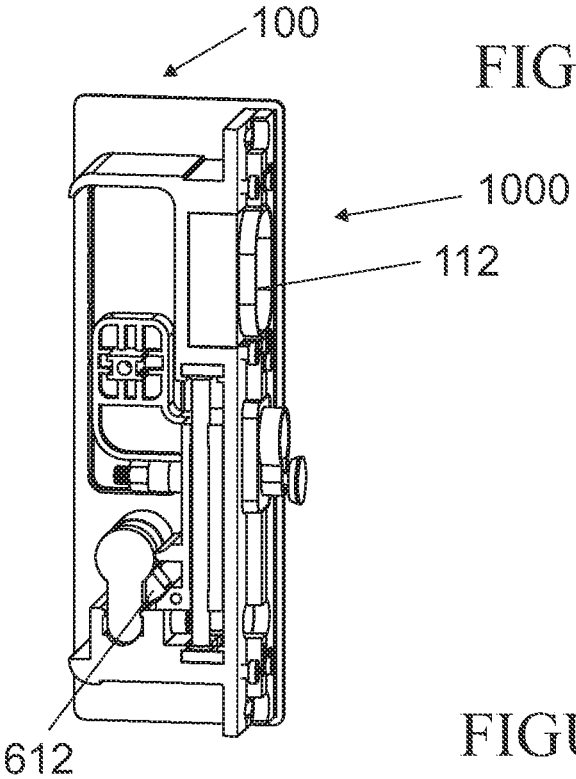
FIG. 5: shows a side perspective view of a latch of latch housing, with a latching member in an engaged position.
Figure 6:
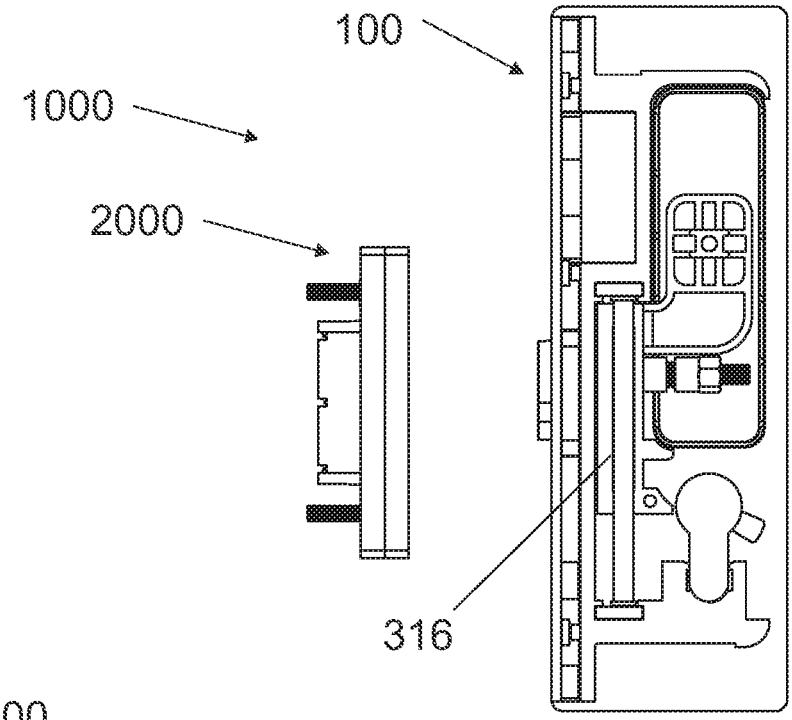
FIG. 6: shows a side view of a latch housing with a cover plate removed, and a strike.
Figure 7:
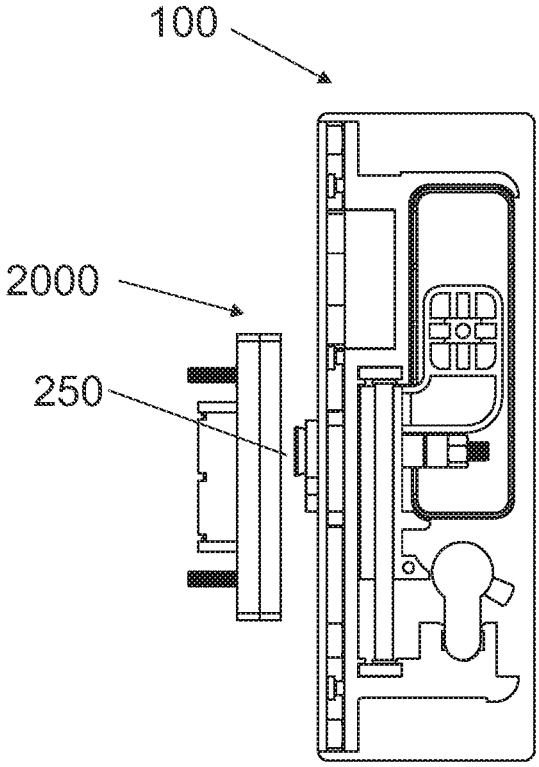
FIG. 7: shows a side view of a latch housing with a cover plate removed, with a latching member partly extended towards a strike.
Figure 8:
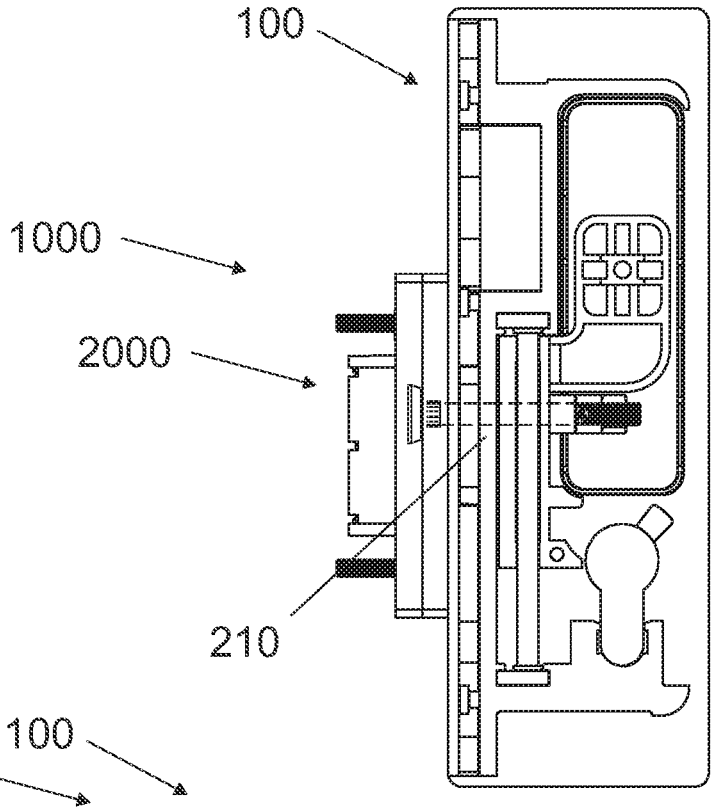
FIG. 8: shows a side view of a latch housing with a cover plate removed, with a latching member extended into a strike.
Figure 9:
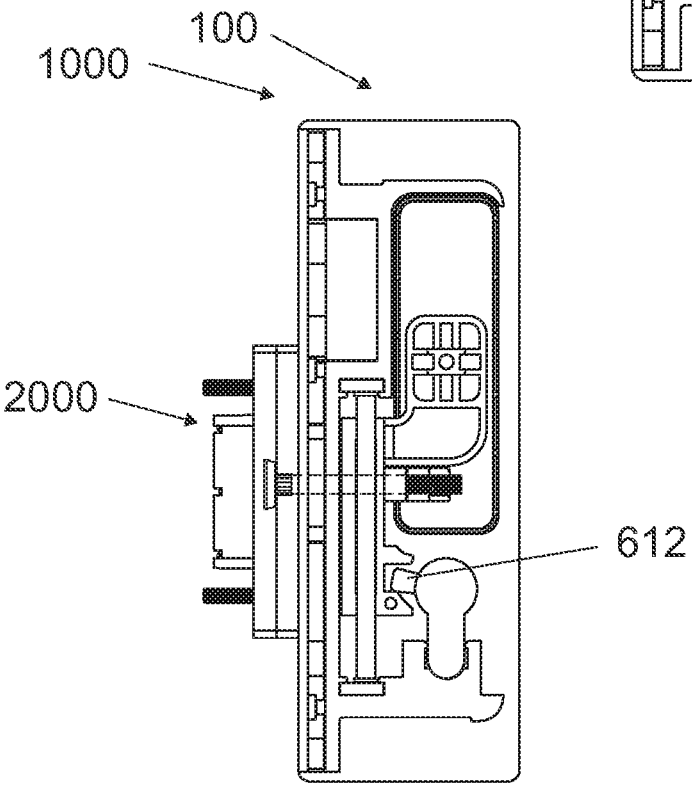
FIG. 9: shows a side view of a latch housing with a cover plate removed, with a latching member extended into a strike, in an engaged locked position.
Figure 10:
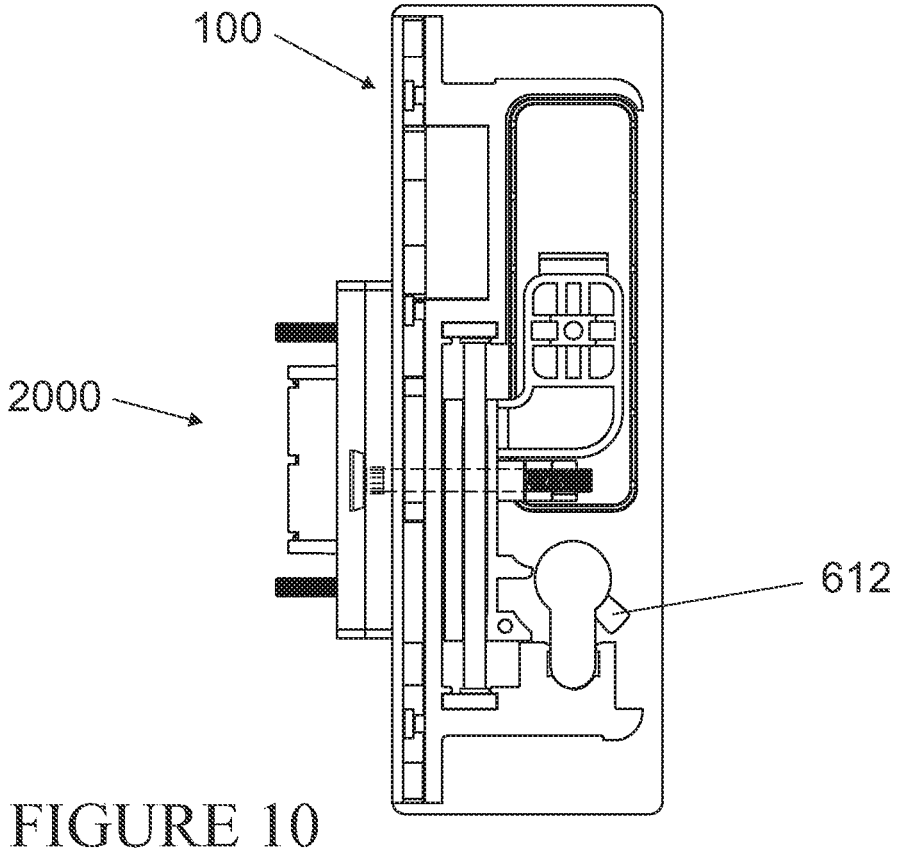
FIG. 10: shows a side view of a latch housing with a cover plate removed, with a latching member extended into a strike, in an engaged unlocked position.
Figure 17:
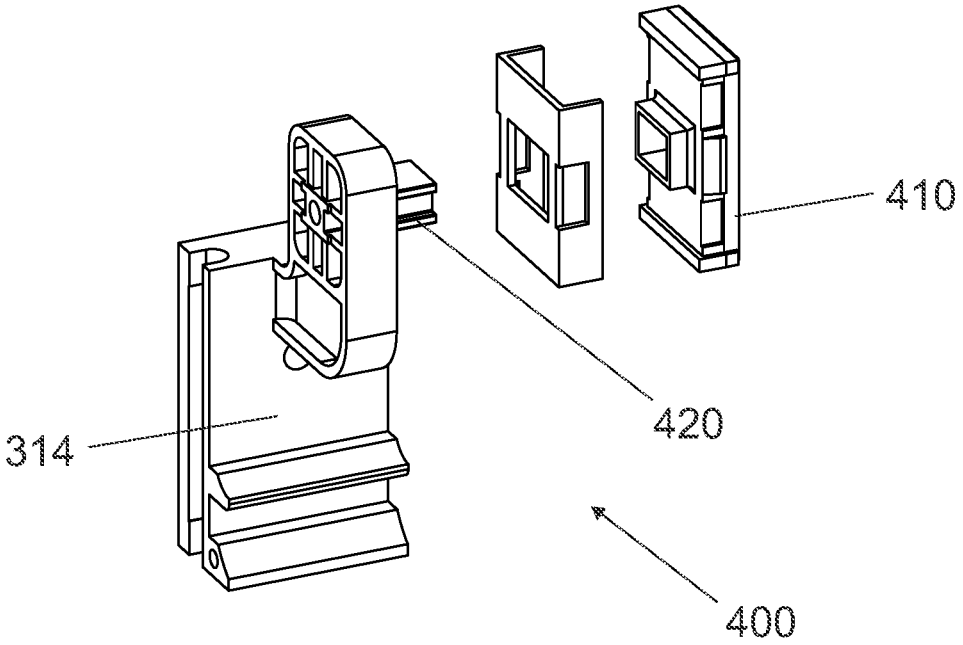
FIG. 17: shows a rear perspective view of a sliding member and associated snib.
Figure 18:
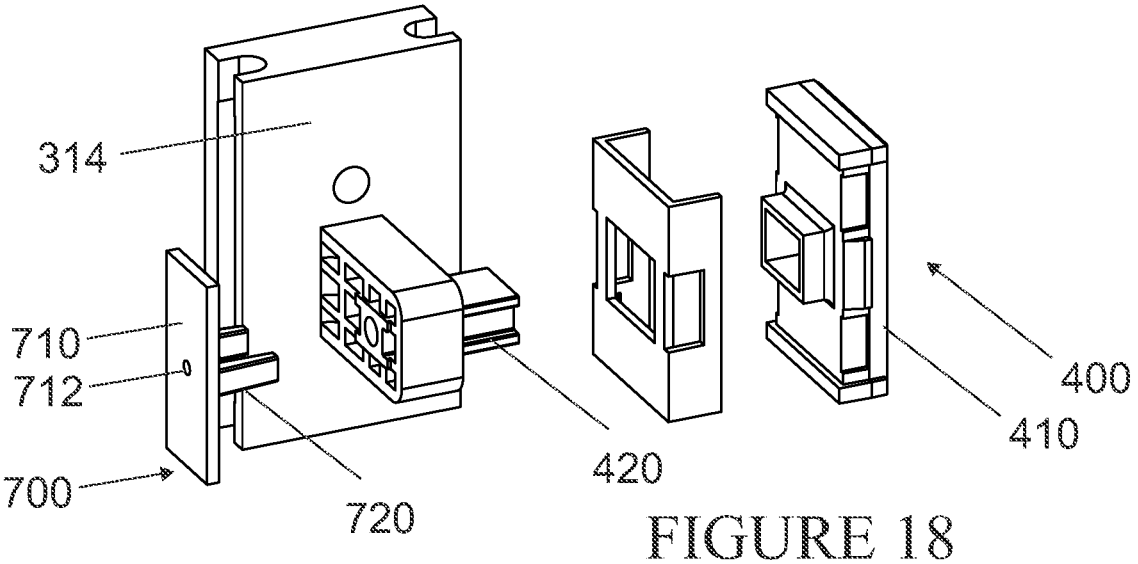
FIG. 18: shows a rear perspective view of a sliding member and associated snib with emergency snib arrangement.
Figure 19:
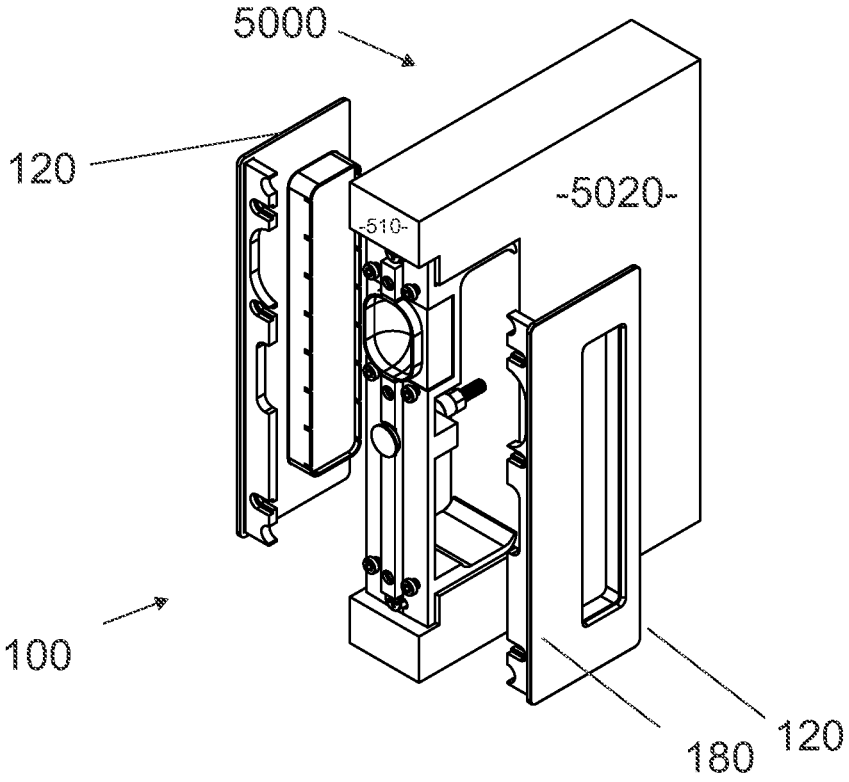
FIG. 19: shows a front isometric view of an exploded latch without a front cover, and a sliding wing.
Figure 20:
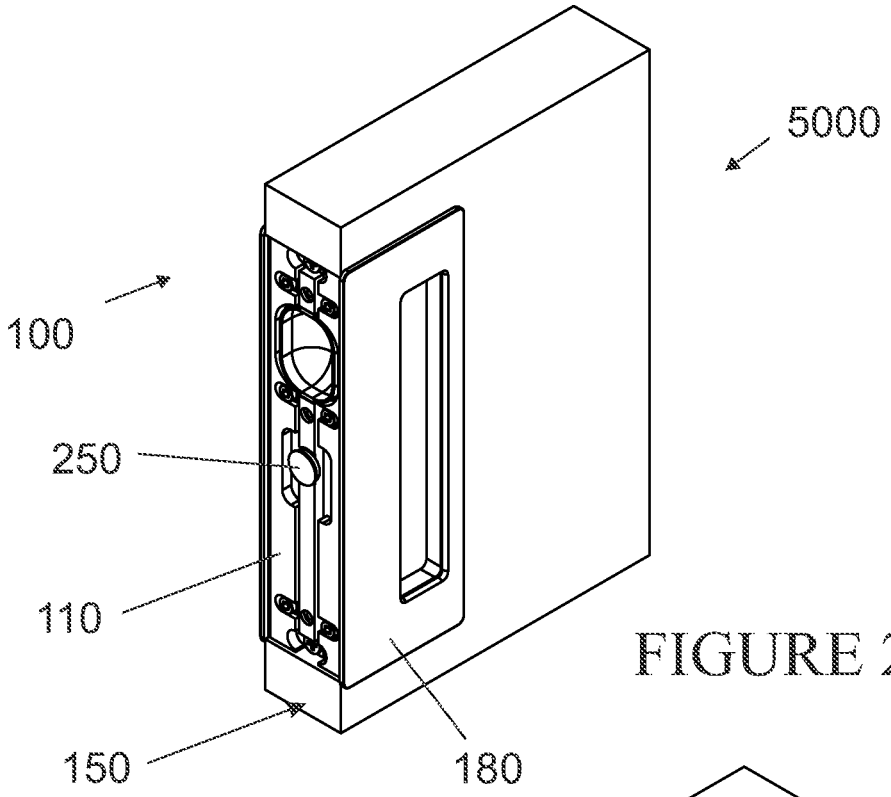
FIG. 20: shows a front isometric view of a latch without a front cover, and a sliding wing.

In one preferred embodiment shown in FIG. 1, the latch arrangement 1000 comprises one or more snibs 400 disposed towards and accessible from one or both sides of the sliding wing. The snib 400 comprises a manually manipulable handle 410 connected or coupled to the sliding member 314 by a connecting formation 420, as shown in FIGS. 17-18. Each snib 400 is movable, preferably in a vertical direction, between an engaged position and a disengaged position which corresponds with the engaged position and disengaged position of the latch moving mechanism 300 respectively as shown in FIGS. 1 and 5 respectively. Each snib 400 is preferably directly connected to the sliding member 314 for moving the latch moving mechanism 300 between its engaged position and disengaged position.

In this way, moving a snib 400 in a vertical direction causes similar movement of the latching member 210 in a similar direction.

In one preferred embodiment shown in FIG. 18, it is envisaged that the latch moving mechanism 300 may comprise an emergency snib arrangement 700. The emergency snib arrangement 700 preferably comprises an emergency engaging formation 710 that is accessible from at least one major face of the housing 100. The emergency engaging formation 710 is connected or coupled to the sliding member 314 by a connecting formation 720, and is movable between an engaged position and a disengaged position corresponding to the engaged position and disengaged position of the latch moving mechanism 300.

The emergency engaging formation 710 is purposely not conveniently manually engageable by a person's hand, and preferably requires a specialised tool to engage with the emergency engaging formation 710. In one preferred embodiment, the emergency engaging formation 710 defines a small aperture 712 that is engageable by a small pointed tool, such as a pen or the like to apply suitable force to move the latch moving mechanism 300 between its engaged position and disengaged position. It is envisaged that the emergency snib arrangement 700 will be provided on an outside of a sliding wing for use where, for example, a small child has locked themselves into a room. In ordinary use, the emergency snib arrangement 700 would not be required to be manipulated with any convenience. The inconvenience of operation of the emergency snib arrangement 700 discourages abuse of privacy in normal use.

In another preferred embodiment, is envisaged that the latch arrangement 1000 and comprise a locking mechanism 600, preferably in the form of a key barrel 610, for locking the movement of the latch moving mechanism 300 by means of a key (not shown). It is envisaged that the locking mechanism 600 will be configured to lock the latch moving mechanism 300 at least in its engaged position, although it is envisaged that the locking mechanism may lock the latch moving mechanism 300 in other positions.

It is aesthetically desirable to have a locking mechanism, such as a key barrel, sitting flush with an outer surface of the housing 100. In one aspect of the invention, the latch arrangement 1000 comprises locating formations 620 for locating the locking mechanism 600 that least partly within the housing 100 in a variety of positions. The locating formations 620 preferably generally define a channel formation within which the locking mechanism 600 is slidable. Securing formations 630, in the form of a threaded bolt 632 movable through a threaded aperture 634 (shown in FIG. 3), serve to secure the locking mechanism 600 in position once it has been slidably adjusted. In this way, the key barrel 610 can be adjusted to align flushly with an outer surface of the housing 100, and one size locking mechanism 600 can be provided for latch arrangements 1000 that have housings 100 of different widths (for example to fit flushly with doors of varying widths).

The locking mechanism 600, preferably in the form of a key barrel 610, comprises a pivoting extension member 612 that can be locked by use of a key. When unlocked, movement of the key in the key barrel 610 causes pivoting movement of pivoting extension member 612. The pivoting extension member 612 is received into a receiving formation 316 on the sliding member 314 so that when something extension member 612 pivots, it sliding member 314 to slide along the shafts 312, thereby causing the latch moving mechanism 300 to move between its engaged position and disengaged position. In this way, turning movement of the key causes movement of the latching member 210 in a vertical direction.

When the key barrel is locked by the key, pivoting movement of the pivoting extension member 612 is prevented. This in turn prevents sliding movement of the sliding member 314 on the shafts 312, thereby locking vertical movement of the latching member 210.

The latch arrangement 1000 is generally intended for operation together with a dedicated strike 2000.

Figure 23:
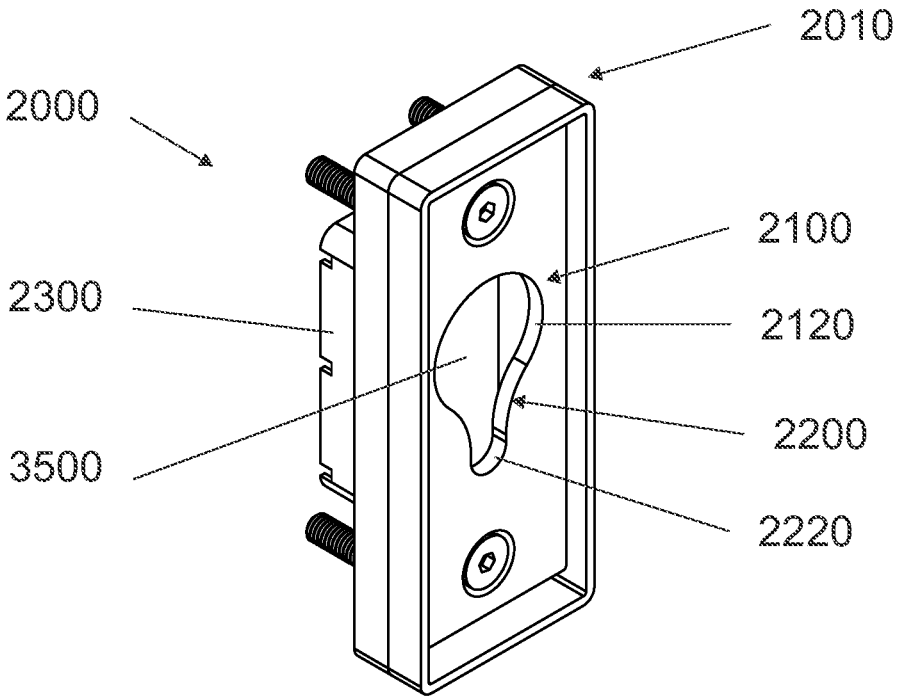
FIG. 23: shows a front isometric view of a strike.
Figure 24:
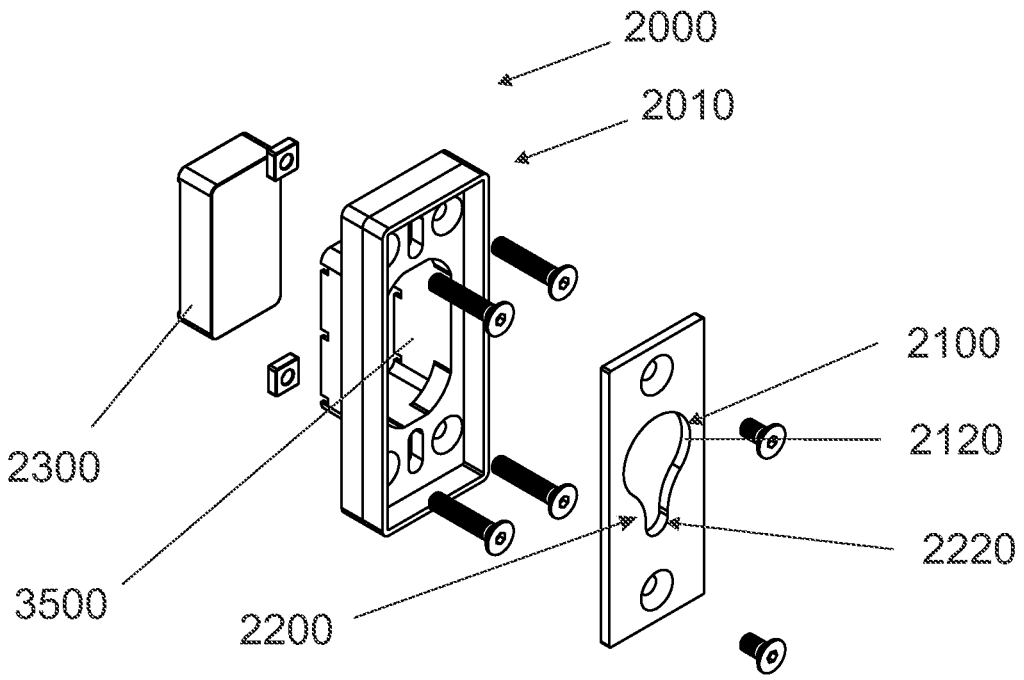
FIG. 24: shows a front exploded isometric view of a strike.
Figure 25:
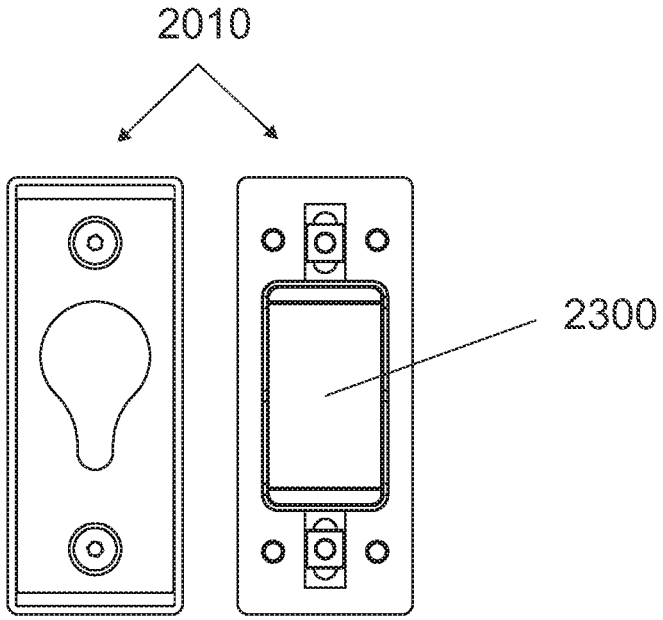
FIG. 25: shows a front and rear view of a strike.
Figure 26:
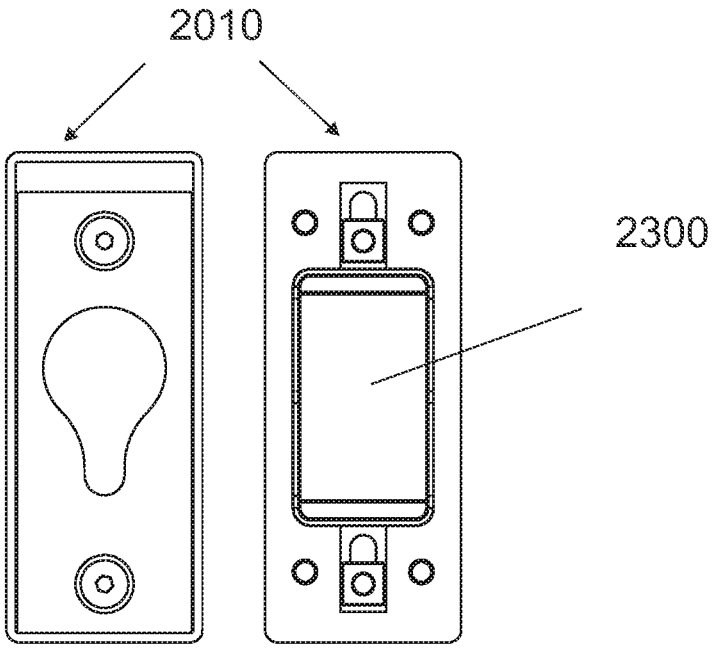
FIG. 26: shows a front and rear view of a strike with a magnetic arrangement in a different position.
Figure 27:
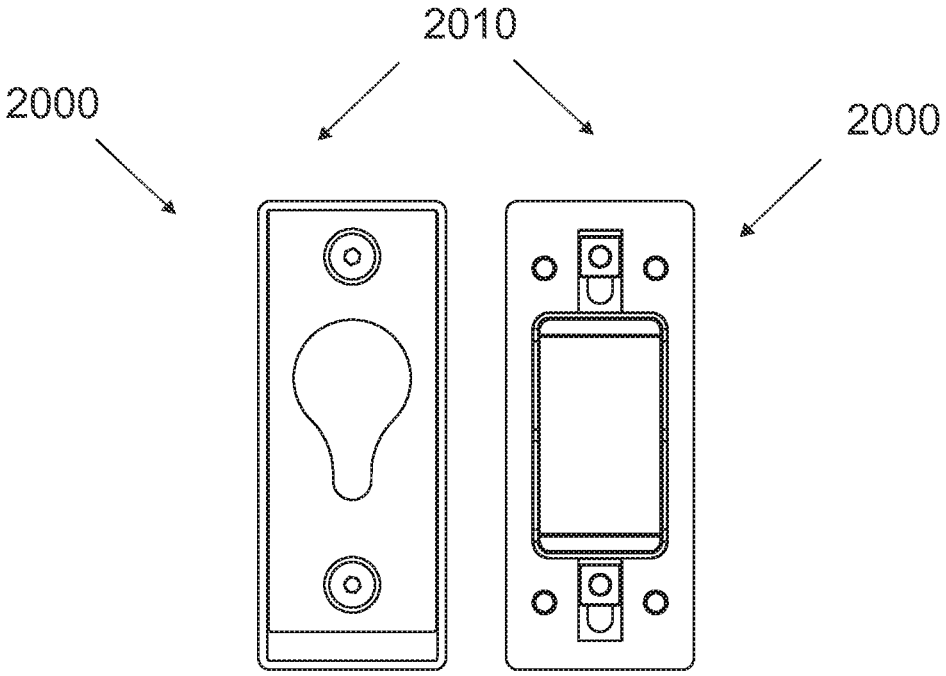
FIG. 27: shows a front and rear view of a strike with a magnetic arrangement in another position.

The strike 2000 comprises a body 2010 and a magnet or ferromagnetic element 2300 as shown in FIGS. 23-24. The body 2010 includes a cavity 3500, a receiving formation 2100, and an engaging formation 2200. The cavity 3500 spans the receiving formation 2100 and the engaging formation 2200 within the strike body. It is envisaged that the body 2010 and the magnetic arrangement 2300 may be integrally formed.

The receiving formation 2100 is for releasably receiving the latching member 210 moving operationally in a first direction, and preferably horizontally. It is envisaged that the receiving formation 2100 will generally comprise one or more selected from an aperture and a recess. As shown in FIG. 24, the receiving formation is embodied as a generally circular aperture 2120, the shape of the receiving formation being complementary to the shape of the latching member 210.

Figure 28:
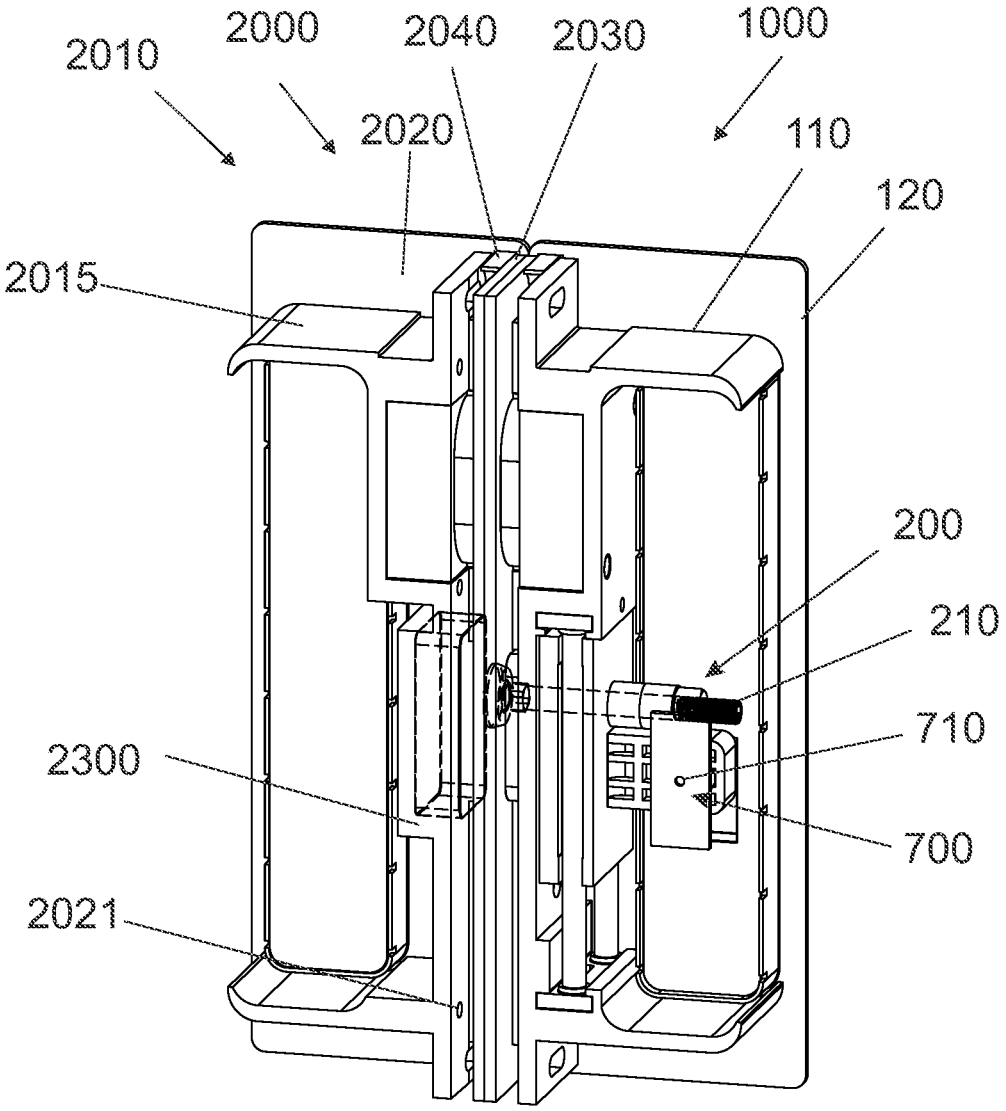
FIG. 28: shows a front perspective view of a strike and a latch arrangement configured for each being mounted to opposed sliding wings.

The strike 2000 can either be located within a doorframe, or in a sliding wing that abuts against the minor face 5010 of the sliding wing 5000 comprising the latching mechanism 1000. An example of a strike 2000 intended to be mounted on a sliding wing is shown in FIG. 28. In this regard, it is envisaged that a strike chassis member 2015 (shown in FIG. 16) similar to the chassis member 110, used to support the latching mechanism 200, may be used as a body 2010 for the strike 2000. This is advantageous as the strike chassis member 2015 is already configured to use the same style cover members 120 as the latch arrangement 1000. It is envisaged that the strike chassis member 2015 could include features similar to any of the features of the chassis member 110, for example

- a handle recess
- threaded holes 2021 for engagement with cover members similar to those of the latch arrangement 1000, and/or
- a minor face that comprises a ridge with one or more angled surfaces.

As shown in FIG. 28, it is anticipated that the strike 2000 could also include strike cover members 2020 with a strike lip formation 2040, and a strike face cover member 2030 for engagement with the strike chassis member 2015, having similar or identical features to the cover members 120 and/or face cover member 170, in order to present a similar appearance to the latch arrangement 1000 when viewed at least from the side of the sliding wing 5000.

Figure 16:
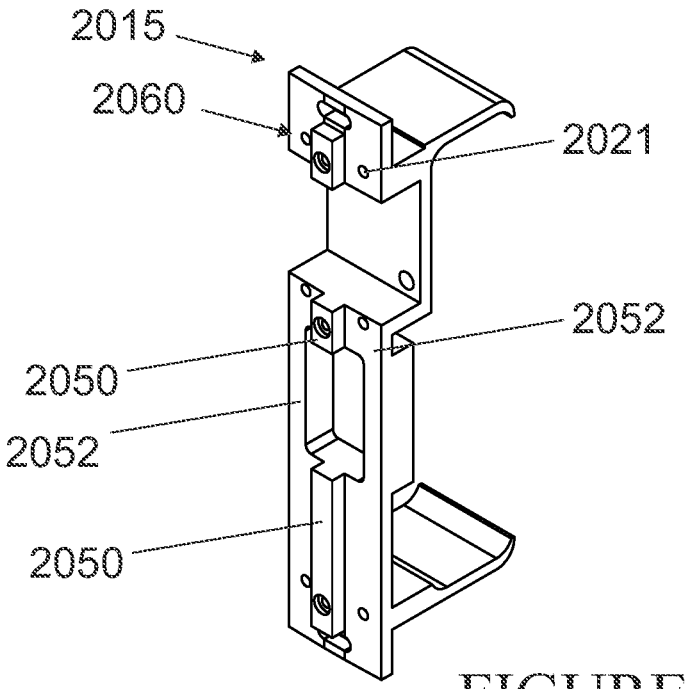
FIG. 16: shows a front perspective view of a chassis member configured to house a strike.

Similarly, the strike chassis member 2015 can include a strike minor face 2060 with a strike ridge 2050 and angled surfaces 2052 similar to the chassis member 110 of the latch arrangement, as shown in FIG. 16.

The engaging formation 2200 is for releasably engaging the latching member 210 when it moves operationally in a second direction transverse to the first direction, and preferably vertically, to prevent the latching member 210 retracting from the strike 2000. In a preferred embodiment, the engaging formation 2200 comprises a slot formation 2220 that is configured and dimensioned for allowing movement of the neck formation 260 of the latching member 210 along the slots formation 2220, while engaging with the head formation 250 to prevent retraction of the latching member into its first position under action of the spring 220. The slot formation 2220 extends from an edge of the receiving formation 2100, so that the receiving formation 2100 defines a major lobe and engaging formation 2200 defines a minor lobe. In a preferred embodiment, the major and minor lobes generally define a keyhole shape.

Specifically, in the preferred embodiment, the head 250 of the latching member is moved in the first direction, through the receiving formation 2100 into cavity 3500. The latching member is then moved in the second direction such that the neck 260 enters the engaging formation 2200, while the head 250 remains in the cavity 3500. The latching member is therefore engaged in the engaging formation 2200 and prevented from moving back into its first position.

The element 2300 is preferably embodied as being a strong permanent magnet 2310, such as a neodymium or similar magnet, located in alignment with the receiving formation 2100 so that when the sliding wing 5000 moves to a close position in which the latch arrangement 1000 is adjacent to or in abutment with the strike 2000, the magnetic portion 240 of the latching member 210 will be attracted by the magnetic arrangement 2300 to move the latching member 210 to its second position in which at least the head formation 50 of the latching member 210 is received within the receiving formation 2100.

In an alternative embodiment, is envisaged that the magnetic arrangement 2300 could be electromagnetic in nature, and consist of an electromagnet (not shown), including a core, conductive windings and a connection to a power source. However, this embodiment is not preferred, as it increases cost and complexity of the strike 2000.

In a preferred embodiment, the latch moving mechanism 300 will only be movable between its engaged position and disengaged position when the latching member 210 is in its second position. This will prevent misalignment of the magnetic portion 240 with the receiving formation 2100. It will be appreciated that the latching member 210 will only extend from the housing 100 when the sliding wing 5000 is in a closed position with the housing 100 located adjacent the strike 2000. In this way, users will not be able to snag clothes or the like on the latching member 210. Further, by first requiring movement of the latching member 210 to its second position before the latch moving mechanism 300 is movable to its engaged position, this means that the latching member 210 will not be accidentally bent or deformed when the sliding wing is closed.

It is anticipated that when the sliding wing is in a close position, and the latch moving mechanism is in its engaged position, the latch arrangement 1000 may be subject to interference or tampering from at least one side of the sliding wing by attempting to access the latching member 210 via an interface created by the abutment between the housing 100 and the strike 2000. For example, known methods of such access include using a planar formation such as a credit card that is slipped between the housing 100 and the strike 2000, in an attempt to move the latching member 210 from its engaged position to its disengaged position, thereby allowing movement of the sliding wing to its open position.

In order to prevent such unauthorised access, the housing comprises a shroud formation 105 that extends around the latch aperture 174 from the housing 100. The shroud formation 105 is configured and adapted to prevent access to the latching member 210 between strike and the housing when the latching member is in its second position, and the latch moving mechanism 300 is in its engaged position. In a preferred embodiment, the shroud formation 105 extends from the face cover member 170, although it is envisaged that it could also extend from the chassis member 110. In an alternative embodiment (not shown), a similarly configured shroud formation could extend from the strike 2000 to be at least partially received into the latch aperture 174 or other apertures specially provided. However, where the door or window frame includes a lip preventing access to the interface between the strike and the housing, then such a shroud formation 105 may not be necessary.

Figure 29A:
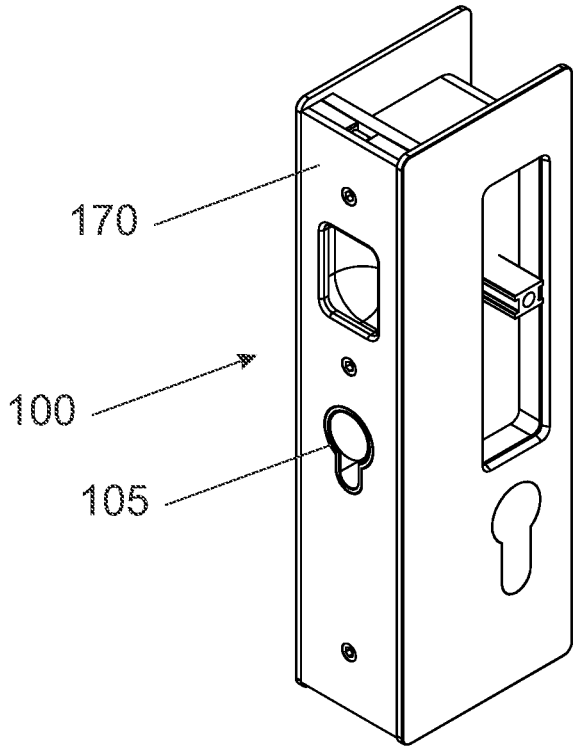
FIG. 29*a*: shows a perspective view of an alternative embodiment of the latch arrangement with a selectively extendable shroud.
Figure 29B:
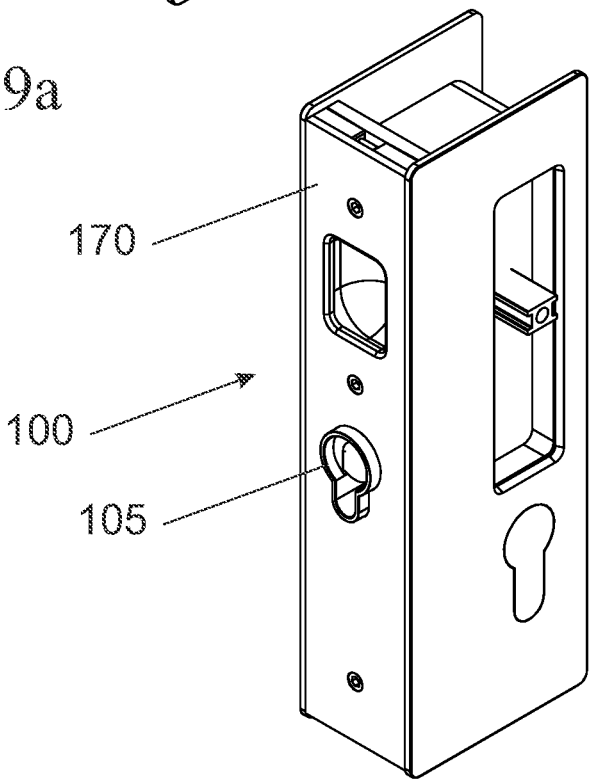
FIG. 29*b*: shows a perspective view of the embodiment of FIG. 29*a*, with the shroud extended.
Figure 30A:
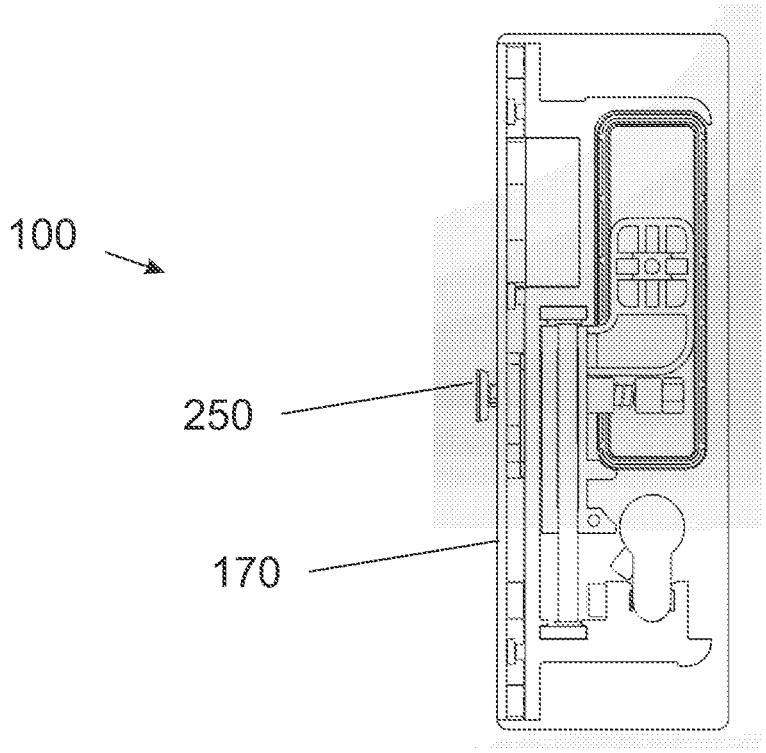
FIGS. 30*a*, 30*b* and 30*c* show side views of the latch arrangement of FIG. 29 with shroud in the retracted, partially extended and fully extended positions respectively.
Figure 30B:
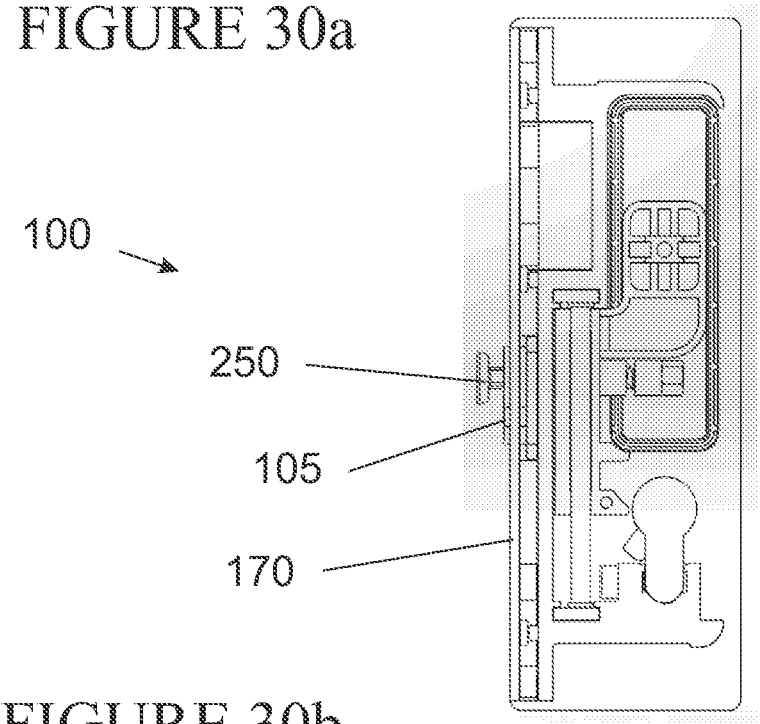
Figure 30C:
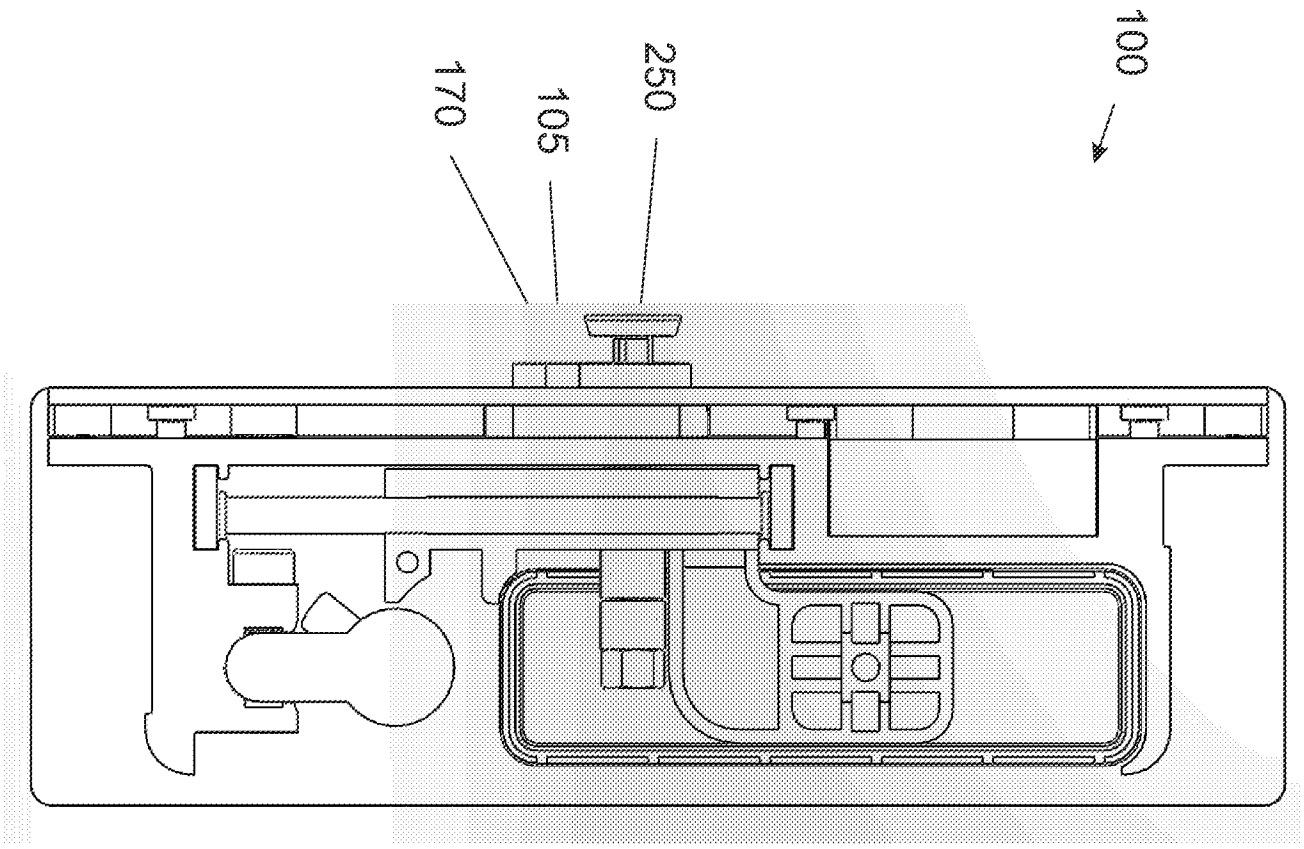
Figure 31:
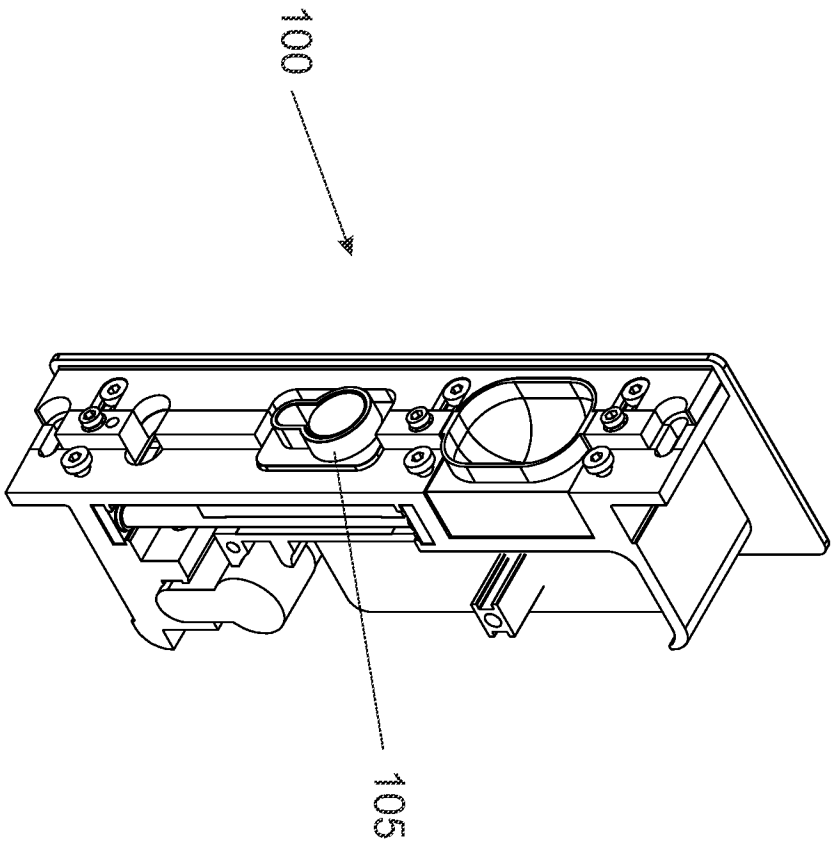
FIG. 31 shows a perspective view of the latch arrangement of FIG. 29, with face cover member removed.
Figure 32:
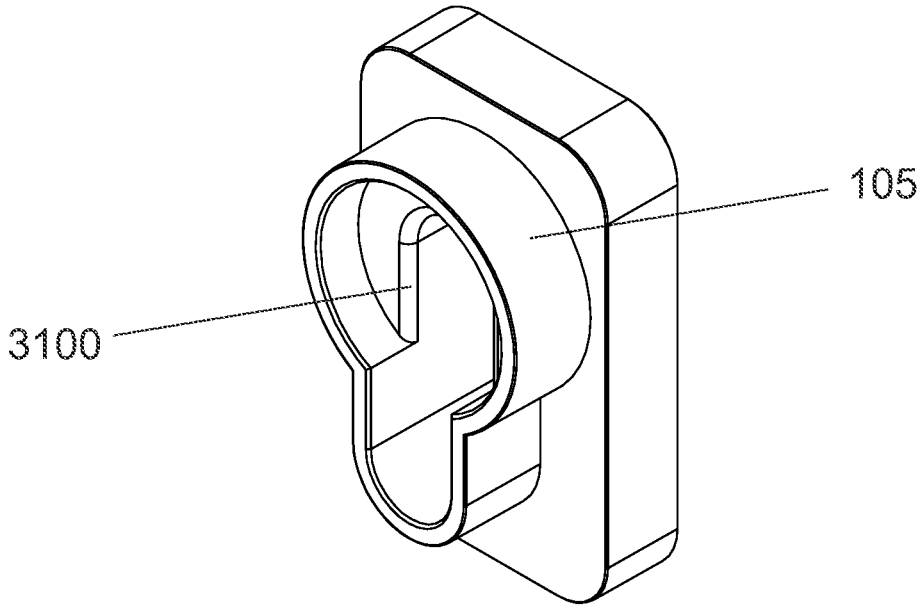
FIG. 32 shows a perspective view of the shroud in isolation.

In a second embodiment as shown in FIGS. 29 to 31, the shroud formation 105 is magnetically extendable from the housing 100, and retractable into the housing 100, or face cover member 170 or chassis member 110 if provided. That is, the shroud formation is movable under magnetic force from a first position in which it is at least partially retracted within the housing, to a second position in which it extends at least partially from the minor face of the housing. The shroud formation 105 may be composed of ferromagnetic material such as iron or steel. Alternatively, a permanent magnet (not shown) may be embedded in the shroud formation to enhance its magnetic attraction.

Magnetic shroud formation 105 is preferably actuated by the magnetic arrangement 2300 in the strike 2000, such that it extends in concert with latching member 210 when the sliding wing 5000 is moved to a closed position in which the latch arrangement 1000 is adjacent to or in abutment with the strike 2000.

The magnetic shroud formation 105 and latching member 210 are preferably configured so that the two components engage with each other as the latching member is retracting into housing 100. For example, the head formation 250 of latching member 210 may be substantially frustoconical in shape, so that the wider portion of the head 250 engages with a lip 3100 of the shroud formation 105, pulling it back into the housing as the latching member 210 is itself retracted into the housing (e.g., under the bias of spring 220).

Alternatively, the magnetic shroud formation 105 may have its own biasing mechanism such as a spring (not shown) to retain the shroud 105 in the housing 100 except when it is acted upon by the magnetic arrangement 2300 in strike 2000.

It will be appreciated that the magnetically extendable shroud formation 105 of the second embodiment in combination with a magnetically actuable latching member 210 will enable all components of the lock to be retracted into the housing 100 when the door wing is open. As discussed previously, this will enhance the appearance of the door, and prevent snagging of clothes or the like on the latching member 210 and/or the shroud formation 105.

In an alternative embodiment (not shown), a magnetic shroud formation may be provided within strike 2000, to be actuable by a magnet in housing 100 (not shown), so that when the shroud is extended it is at least partially received into the latch aperture 174 or other apertures specially provided.

Additionally, it is envisaged that when the door is in the closed and locked position, the latch could potentially be tampered with by lifting the entire sliding wing such that the latching member 210 is lifted out of the engaging formation 2200 and into the receiving formation 2100. The door would then be openable.

Figure 33:
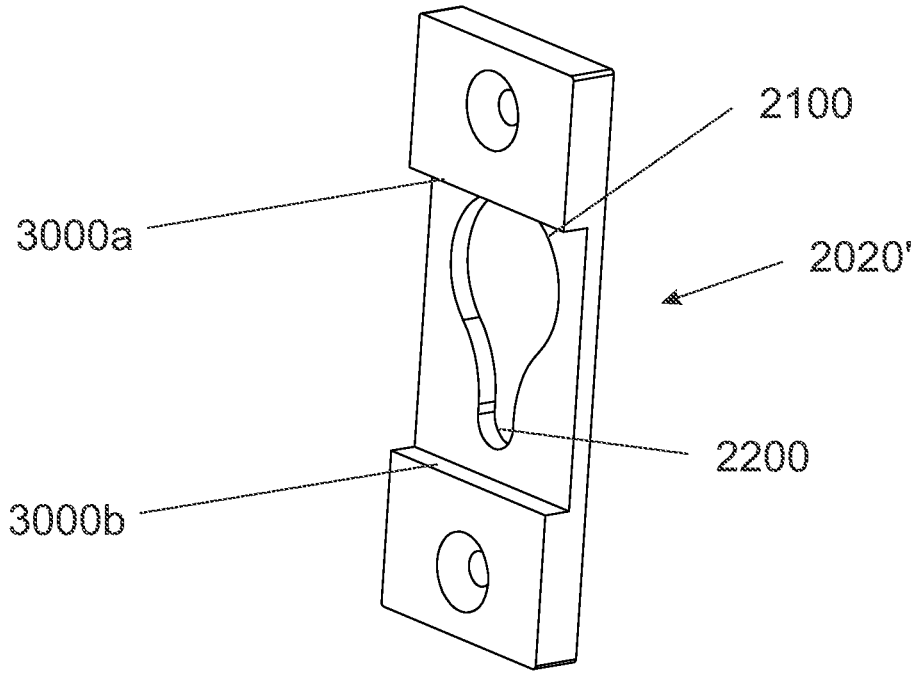
FIG. 33 shows an alternative embodiment of a cover member for a strike.

Accordingly, an alternative strike 2000 may comprise an alternative cover member 2020' having an anti-tamper feature as shown in FIG. 33. The alternative cover member 2020' may comprise at least one outwardly protruding formation such as lips 3000. Specifically, the lips 3000 extend forwards towards the direction of the latch arrangement 1000 when the sliding wing is closed (i.e., adjacent the strike).

Preferably, outwardly extending upper lip 3000*a* and/or lower lip 3000*b* are positioned adjacent or near to the top edge of receiving formation 2100 and the bottom edge of engaging formation 2200 respectively. That is, the lip(s) is/are located adjacent the receiving formation 2100 and/or the engaging formation 2200 along the second direction of movement of the latching member 210 (preferably vertical), to prevent tamper of the latching member in the second direction, while the shroud formation 105 is extended. For example, if an attempt is made to tamper with the door by lifting the sliding wing, the shroud formation 105 would abut against the upper lip 3000*a*, preventing the latching member 210 from being lifted out of the engaging formation 2200.

Alternatively, if the configuration of the receiving formation 2100 and engaging formation 2200 of the strike 2000 is reversed, such that latching member 210 is raised instead of lowered in order to lock the latch within the strike, bottom lip 3000*b* may be provided to prevent the tampering by lowering the sliding wing. Alternatively, both top and bottom lips 3000*a* and 3000*b* may be provided. Further, while the anti-tamper feature is shown as lips 3000, it may alternatively be any other suitable formation, such as a narrow ridge or other protrusion on the strike 2000.

It is envisaged that the latch arrangement could be presented with a wide variety of configurations, including a pair of key barrels, with one key barrel accessible from each major face of the sliding wing. Alternately, the latch arrangement could present a snib and/or emergency snib arrangement accessible from each major face of the sliding wing, or any combination of snibs, emergency snib arrangements and key barrels. It is envisaged that the latch arrangement 1000, even if provided without a latch moving mechanism 300, snibs 400 or locking mechanism 600, will still provide the desirable benefit of holding the sliding wing 5000 in a closed position by virtue of the magnetic arrangement 2300 attracting the magnetic portion 240 of the latching member 210. This may be particularly beneficial where, for example a sliding wing has been set on a track (not shown) that is not perfectly horizontal. To this extent, it is envisaged that the strike 2000 need not include the receiving formation 2100 or the engaging formation 2200, but may merely provide for a magnetic arrangement 2300.

Where in the foregoing description reference has been made to elements or integers having known equivalents, then such equivalents are included as if they were individually set forth.

Although the invention has been described by way of example and with reference to particular embodiments, it is to be understood that modifications and/or improvements may be made without departing from the scope or spirit of the invention.

In addition, where features or aspects of the invention are described in terms of Markush groups, those skilled in the art will recognise that the invention is also thereby described in terms of any individual member or subgroup of members of the Markush group.

The invention claimed is:

1. A latch arrangement for a sliding wing, the latch arrangement comprising:

a chassis mounted to said wing, a latching mechanism supported by the chassis, the latching mechanism having a latching member comprising one or both of:

a magnet, a ferromagnetic portion, the latching member being movable between a first position in which the latching member is at least partially retracted within the wing, and a second position in which the latching member extends out of the wing for being received by a strike, wherein the latching mechanism is movable from the first position to the second position by magnetic force interacting between said latching member and said strike, and wherein said chassis is located within said wing in a through cutout, and mounted to said wing only by a plurality of fasteners engaged with a minor face of said wing in said cut out, and wherein the latch arrangement comprises two side cover members, each to cover said through cutout on opposite sides of the wing.

2. The latch arrangement as claimed in claim 1, wherein the cover members are each configured to be secured to said chassis member by adjustable securing formations including at least one slot formation for receiving at least one cover fastener in a friction fit.

3. The latch arrangement as claimed in claim 2, wherein said cover fasteners are only oriented normal to said minor face of said wing.

4. The latch arrangement as claimed in claim 1, wherein the chassis member is an extruded member trimmed to fit a thickness of said wing.

5. The latch arrangement as claimed in claim 1, wherein the latch arrangement comprises a face cover member configured for covering the chassis member along a plane coplanar with said minor face of the sliding wing.

6. The latch arrangement as claimed in claim 1, wherein the latch arrangement further comprises at least one shroud formation extending from the minor face of the wing, the shroud formation configured and adapted to prevent access to the latching member between the strike and the chassis when the latching member is in the second position.

7. The latch arrangement as claimed in claim 1, wherein the latching member, in the second position, is configured to extend from a minor face of the wing.

8. The latch arrangement as claimed in claim 1, wherein the latch arrangement comprises a locking mechanism configured for moving the latching member in a direction substantially transversely to the direction of movement of the latching member when moving between the first and second positions, the locking mechanism configured to move the latching member between:

an engaged position in which the latching member cannot be withdrawn from the strike by sliding the wing, and a disengaged position in which the latching member can be withdrawn from the strike by sliding the wing.

9. The latch arrangement as claimed in claim 1, wherein the latching member is biased towards the first position via a spring.

10. The latch arrangement as claimed in claim 1, wherein the length which the latching member extends from the housing in the second position is adjustable by an adjustment mechanism comprising a threaded portion on said latching member and a nut.

11. The latch arrangement as claimed in claim 10, wherein the adjustment mechanism allows for adjustment of the biasing force exerted by the spring formation.

12. The latch arrangement as claimed in claim 1, wherein the latch arrangement is installed in the sliding wing such that the latching member in the first position is configured to be located flush with an edge of the sliding wing.

13. The latch arrangement as claimed in claim 8, wherein the latch arrangement comprises a snib for moving the locking mechanism between the engaged position and disengaged position.

14. The latch arrangement as claimed in claim 8, wherein the latch arrangement comprises a lock for locking movement of the locking mechanism at least in the engaged position.

15. The latch arrangement as claimed in claim 1, wherein a magnetic arrangement providing said magnetic force for moving the latching member is located in the strike.

16. The latch arrangement as claimed in claim 1, wherein the strike is mounted to a second, and opposed, sliding wing.

17. The latch arrangement as claimed in claim 8, wherein the locking mechanism is only movable between its engaged position and disengaged position when the latching member is in its second position.

* * * * *